US007981586B2

(12) United States Patent
Uchino et al.

(10) Patent No.: US 7,981,586 B2
(45) Date of Patent: Jul. 19, 2011

(54) IMAGE FORMING METHOD USING THE SAME

(75) Inventors: Satoshi Uchino, Tokyo (JP); Masahiro Anno, Tokyo (JP); Takeo Oshiba, Tokyo (JP); Okushi Okuyama, Tokyo (JP); Shinya Obara, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 985 days.

(21) Appl. No.: 11/850,802

(22) Filed: Sep. 6, 2007

(65) Prior Publication Data

US 2008/0070147 A1 Mar. 20, 2008

(30) Foreign Application Priority Data

Sep. 19, 2006 (JP) ..... 2006-252406

(51) Int. Cl.
*G03G 9/06* (2006.01)

(52) U.S. Cl. ..... 430/123.3; 399/286; 399/176; 399/159

(58) Field of Classification Search ..... 399/286, 399/176, 159; 430/123.3
See application file for complete search history.

(56) References Cited

U.S. PATENT DOCUMENTS

2006/0171760 A1* 8/2006 Deguchi ..... 400/642
2008/0292366 A1* 11/2008 Akama et al. ..... 399/286

FOREIGN PATENT DOCUMENTS

JP 8190263 7/1996
JP 2000214629 8/2000
WO WO 2006001171 * 1/2006

* cited by examiner

*Primary Examiner* — Mark F Huff
*Assistant Examiner* — Rachel L Zhang
(74) *Attorney, Agent, or Firm* — Lucas & Mercanti, LLP

(57) ABSTRACT

An electrophotographic image forming method is disclosed. The method includes steps of conveying a developer comprising a toner to a developing zone by a developing roller, and developing an electrostatic latent image formed on an electrostatic latent image carrying member by the developer, and the developing roller has an electroconductive shaft and a resin layer provided around the shaft, the resin layer comprises a surface layer containing silicone copolymer resin as the principal component and a layer containing resin-silica hybrid composite as a principal component provided directly under the surface layer.

10 Claims, 3 Drawing Sheets

IMAGE FORMING METHOD USING THE SAME

This application is based on Japanese Patent Application No. 2006-252406 filed on Sep. 19, 2006, in Japanese Patent Office, the entire content of which is hereby incorporated by reference.

TECHNICAL FIELD

This invention relates to a developing roller and an image forming method to be used for electrophotographic image forming apparatus such as copying machines, printer and facsimile receiver.

TECHNICAL BACKGROUND

In the electrophotographic image forming method, an image is usually formed on a transferring sheet according to the following processes. Namely, an electrified toner is supplied onto an electrostatic latent image formed on an electrostatic latent image carrier typically an electrophotographic photoreceptor by contacting or non-contacting method for developing the electrostatic latent image to form a visible image, and the resultant toner image formed on the electrostatic latent image carrier is transferred onto paper and then fixed to form a final image.

The developing method for forming the toner image on the electrostatic latent image carrier includes a double-component developing method using a double-component developer and a single-component developing method using a single-component developer singly composed of a toner. In the single-component developing system, carrier is not used and the toner is charged by rubbing and pressing with an electrifying member or the surface of a developing roller. Therefore, such the method has a merit that the structure of the developing device can be simplified and made compact. Particularly, the image formation by the non-magnetic single-components developing system is influential to full color image forming apparatus corresponding to colorization of toner image, in which plural developing devices such as those for yellow, magenta, yellow and black toners have to be arranged in a limited space. Moreover, full color pictorial image can be formed by the use of polymerized toner which can be produced while controlling the size and the shape of the toner particle in the course of the production process; cf. Patent Document 1, for example.

The developing roller to be used for image formation by the non-magnetic single-component developing system, for example, has a constitution in which a resin layer is placed on a rubber layer provided on the circumstance of a shaft, and a thin layer of toner is formed on the developing roller by a metal plate or a roller. The thin layer of toner is electrified by the friction with the above metal plate or the roller.

The resin layer formed on the surface of the developing roller is required to stably donate electricity to the toner and to suitably convey the toner, and technology for preventing the adhesion or fusion of the toner onto the developing roller surface is investigated hitherto. For example, use of a fluororesin and improving the properties thereof has been tried.

Moreover, improvement in the durability by a means such as formation of strong contact between the resin layer and the rubber layer has been demanded since large load is applied not only to the toner but also to the developing roller on the occasion of the formation of the toner thin layer performed on the developing roller surface. Consequently, a developing roller improved in the durability by forming an inter layer formed by employing a silane coupling agent and further forming thereon a resin layer principally composed of fluororesin is disclosed. The inter layer is also called an adhesive layer because of its purpose of adhesion. Cf. Patent Document 2, for example.

Patent Document 1: Japanese Patent Open to Public Publication (JP A) No. 2000-214629

Patent Document 2: Japanese Patent Open to Public Publication (JP A) No. 8-190263

DISCLOSURE OF THE INVENTION

Problems to be Solved by the Invention

In the non-magnetic single-component development, counter charge to that of the toner tends to be accumulated on the developing roller surface because the charge transfer is carried out between the toner and the developing roller. Therefore, it is necessary for stably performing suitable image formation that the counter charge accumulated on the developing roller is leaked so as to make the developing roller surface to electrically neutral state.

However, the developing roller disclosed in the forgoing patent document cannot efficiently leaks the counter charge generated on the surface thereof. Accordingly, the charge remains on the developing roller surface so that suitable quality of the printed image is difficulty provided.

Recently, printing business corresponding to on-demand printing is raised, in which full color prints are produced by electrophotographic printer in stead of usual printing system. In such the field, increasing in the remaining charge accompanied with the repeating operation will be impediment for stably provision of high quality printed matter. Besides, the durability of the developing roller has to be considered for stably providing the high quality printed matter. The above two problems are very difficulty solved at the same time by only adding a substance for accelerating the leaking.

SUMMARY OF THE INVENTION

The object of the invention is to provide a developing roller to be used for development by the non-magnetic single-component developing system, which can efficiently leak the counter charge generated on the roller surface and has high durability.

The inventors found that the object of the invention can be attained by the following constitution.

The invention in one aspect is a developing roller having a resin layer around an electroconductive shaft, wherein the resin layer comprises a surface layer containing silicone copolymer resin as the principal component and a layer containing a resin-silica hybrid composite as the principal component, which is provided directly under the surface layer.

An example of preferable resin constituting the resin-silica hybrid composite of the developing roller is a resin containing a urethane-bond.

An example of the preferable resin containing a urethane-bond is a polyurethane resin.

Another example of the preferable resin constituting the resin-silica hybrid composite of the developing roller is a resin comprising vinyl polymer.

An example of the preferable vinyl polymer comprises polymethacrylic acid or polyacrylic acid.

The invention in other aspect is an image forming method comprising the steps of conveying a developer solely composed of a toner to a developing zone by a developing roller, and developing an electrostatic latent image formed on an electrostatic latent image carrying member by the developer, wherein the developing roller has an electroconductive shaft and a resin layer provided around the shaft and the resin layer comprises a surface layer containing silicone copolymer resin as the principal component and a layer which is provided directly under the surface layer containing resin-silica hybrid composite as the principal component.

The resin-silica hybrid composite containing polyurethane resin is preferably used in this image forming method.

The resin-silica hybrid composite comprising polymethacrylic acid and polyacrylic acid is also preferably used in the image forming method.

By the present invention, the counter charge is difficulty accumulated on the developing roller surface and the toner image having suitable quality can be obtained.

Hitherto, it has been considered to provide a property accelerating the leak of charge to the developing roller. For example, a method is known in which carbon black is added into the resin layer and the resin itself has a polar group so as to lower the resistivity of the resin for accelerating the leak of the charge. By this method, however, the resistivity of the roller is wholly lowered and the image formation is received influence of the resistivity variation. Thus the inhibition of the counter charge hitherto accompanies difficulties.

It is supposed that the counter charge generated on the roller surface is immediately leaked to the shaft by the structure of the developing roller according to the invention that the resin layer is provided around the electroconductive shaft. Moreover, it is also supposed that the resin layer composed of the outermost surface resin layer containing the silicone copolymer resin as the principal component and the layer provided directly under the outermost resin layer and containing the resin-silica hybrid composite as the principal component and theses ingredients affect so that the counter charge is easily transferred.

Particularly, high quality full color prints can be stably provided for long period by full color image forming apparatus corresponding to the on-demand system by the invention.

PREFERABLE EMBODIMENTS OF THE INVENTION

Figure 1:
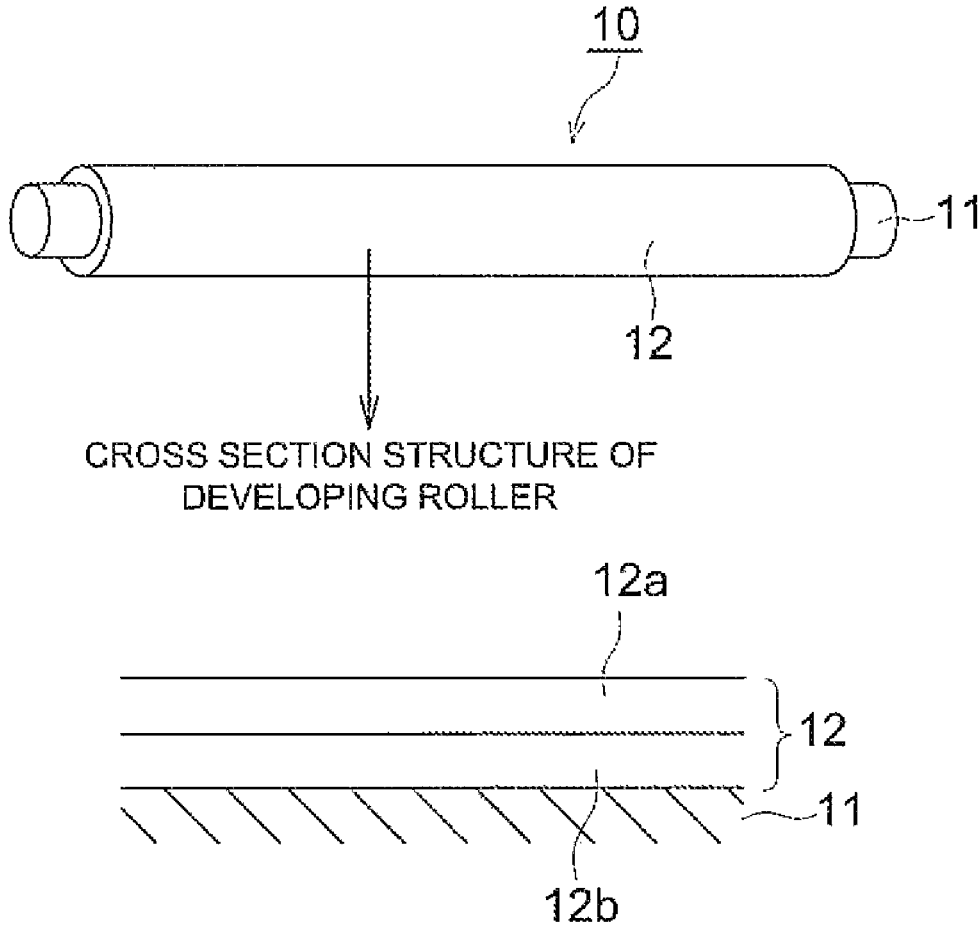
FIG. 1 shows a scheme drawing of appearance and the cross section structure of the developing roller of the invention.

The invention relates to the developing roller having the resin layer around the electroconductive shaft, particularly, the resin layer comprises a surface layer containing the silicone copolymer as the principal component and the layer provided directly under the surface layer and containing resin-silica hybrid composite as the principal component. In such the structure, leak points composed of inorganic component is finely dispersed in the molecule since a silica unit exists in the molecule. Therefore, it is supposed that the suitable leaking ability and the insulation ability of the resin itself is suitably balanced so that the effects of the invention are realized.

In the developing rollers of the invention, the resin layer provided around the shaft has the surface layer containing the silicone copolymer as the principal component and the layer provided directly under the surface layer containing the resin-silica hybrid composite as the principal component. According to the invention, degradation of the image quality caused by raising the remaining potential accompanied with repeating of the image formation is prevented. It is supposed that such the effect is obtained by the structure of the roller that the resin layer is directly provided on the electroconductive shaft, without providing a rubber layer, so that the counter charge generated on the roller surface is easily transferred to the shaft. Besides, the effects of the invention cannot be obtained by one containing no resin-silica hybrid composite in the resin layer even when the roller has the similar structure to the roller of the invention. Consequently, it is supposed that the resin-silica hybrid composite somewhat contributes on acceleration of the leaking of the remaining charge.

Moreover, the invention makes possible to provide the developing roller having high durability. The resin layer provided on the shaft is difficulty come off between the surface layer and the layer provided directly under the surface layer so that the developing roller is not damaged by repeating image formation and stable image formation is made possible because of good adhesion characteristics between these layers.

It is also supposed that the adhesion between the shaft of the developing roller and the resin roller is improved and high durability is provided by that the resin-silica hybrid composite displays affinity to both of the surface resin layer and the shaft surface in one of a preferable embodiment of this invention.

Furthermore, in the developing roller of the invention, the adhesion of the toner to the roller can be inhibited by lowering the surface energy of the roller by the presence of the silicone copolymer in the surface layer. Hitherto, a technology using silicone resin for preventing the adhesion of the toner onto the roller surface is known but the strong adhesion between the layer provided directly under the surface layer and the resin is difficulty formed. In the invention, strong adhesion can be formed between the outermost portion of the resin layer and the portion containing the resin-silica hybrid composite as the principal component can be realized by the use of silicone copolymer constituted by copolymerization with a component having polarity. Consequently, it is supposed that such the strong adhesion can be caused by that the components of the silicon copolymer each display affinity with the components of the resin-silica hybrid composite.

The invention is described in detail below.

The developing roller of the invention has a resin layer including the surface layer containing the silicone copolymer as the principal component and the layer provided directly under the surface layer and containing the resin-silica hybrid composite as the principal component. The "principal component" means that the content of the silicone copolymer in the surface layer and that of the resin-silica hybrid composite in the layer provided directly under the surface layer are each not less than 50%.

The resin-silica hybrid composite used in the invention is formed by coating a resin layer constitution liquid containing a reaction product of a resin having a functional group reactive to an epoxy group with an alkoxysilane condensate such as a tetramethoxysilane condensate and a tetraethoxysilane condensate on the shaft and performing thermal processing.

The developing roller of the invention has a resin layer around the electroconductive shaft and the resin layer includes the surface layer containing the silicone copolymer as the principal component and the layer provided directly under the surface layer and containing the resin-silica hybrid composite as the principal component. The typical cross sectional constitution of the developing roller of the invention is shown in FIG. 1. The developing roller of the invention is not limited to that having the cross sectional constitution displayed in FIG. 1.

A developing roller 11 is constituted by an electroconductive shaft 11 and a resin layer 12 provided on the shaft 11, and a surface layer 12*a* containing the silicone copolymer as the principal component is on the surface of the resin layer, and a layer 12*b* containing the resin-silica hybrid composite as the principal component is directly under the surface layer 12*a*. In FIG. 1, the layer 12*h* containing the silicone copolymer and the surface layer 12*a* containing the resin-silica hybrid composite are shown as distinguishable layers but the invention included a case in which the structure of layers are difficulty discriminated visually by electron microscope.

The shaft 11 is composed of an electroconductive material, concretely a metallic material, for example, stainless steel such as SU304, iron, nickel, aluminum alloy and nickel alloy is preferable. Electroconductive resin filled with a powder of the foregoing metal or an electroconductive material such as carbon black is also usable.

In the resin layer, the surface layer 12*a* containing the silicone copolymer as the principal component and, the layer provided directly under the surface layer and containing the resin-silica hybrid composite are exist. The silicone copolymer resin to be contained in the surface layer 12*a* is a resin constituted by a copolymer formed by molecular bonding a silicon polymer having a main chain structure in which silicon atom bonded with an organic group and an oxygen atom are alternatively bonded and a polymer having a urethane-bond or a vinyl polymer. The silicone copolymer usable in the invention is concretely described in detail later.

The layer 12*b* constituting the resin layer 12 contains the resin-silica hybrid composite as the principal component. The resin-silica hybrid composite to be contained in the layer 12*b* is a compound in which a resin component and a silica component are unified by molecular bonds. Namely, the composite is constituted by a portion of a silica structure, referred to as a silica skeleton in the invention, having a net work formed by alternatively bonded silicon and oxygen and a portion constituted by a polyurethane resin or a vinyl polymer resin.

In concrete, an alkoxy group-containing silane-modified resin is formed by reaction of a resin having a functional group including an epoxy group and a reactive group with a partial condensate of an epoxy group-containing alkoxysilane, and a silica structure is formed by curing the resultant alkoxy group-containing silane-modified resin by condensation reaction. The resin-silica hybrid composite usable in the invention is concretely described in detail later.

Carbon black may be contained in the resin layer 12 of the developing roller relating to the invention. The resin layer 12 is given some degree of electroconductivity by such the addition of carbon black so that the leaking of the remaining charge generated on the roller surface to the shaft is accelerated.

The thickness of the resin layer 12 is preferably within the range of from 2 to 60 μm and particularly preferably from 8 to 40 μm.

The thickness of the surface layer 12*a* is preferably within the range of from 1 to 30 μm and particularly preferably from 3 to 20 μm.

The thickness of the layer containing resin-silica hybrid composite 12*b* is preferably within the range of from 1 to 30 μm and particularly preferably from 5 to 20 μm. The thickness of the resin layer can be measured by sampling of cross section of the resin layer from the developing roller and electron microscopic photographing the cross section sample.

The resin layer formed around the electroconductive shaft include one having a layer structure containing plural layers such as the surface layer and an intermediate layer.

The resin layer may be provided directly on the electroconductive shaft or indirectly on another layer provided on the electroconductive shaft. The resin layer consists of the surface layer and the layer containing resin-silica hybrid composite provided directly on the electroconductive shaft in one of the preferable embodiment. The preferable developing roller consists of the shaft, the layer containing resin-silica hybrid composite provided directly on the electroconductive shaft and the surface layer directly provided on the layer containing resin-silica hybrid composite.

The resin layer provided directly under the surface layer of the developing roller contains the resin-silica hybrid composite and the resin layer strongly adheres with the surface layer. The peeling resistive strength between the resin layer 12*b* and the surface layer 12*a* can be measured by, for example, measurement of interlayer adhering force shown in FIG. 2. The measurement is performed by the following procedure.

Figure 2:
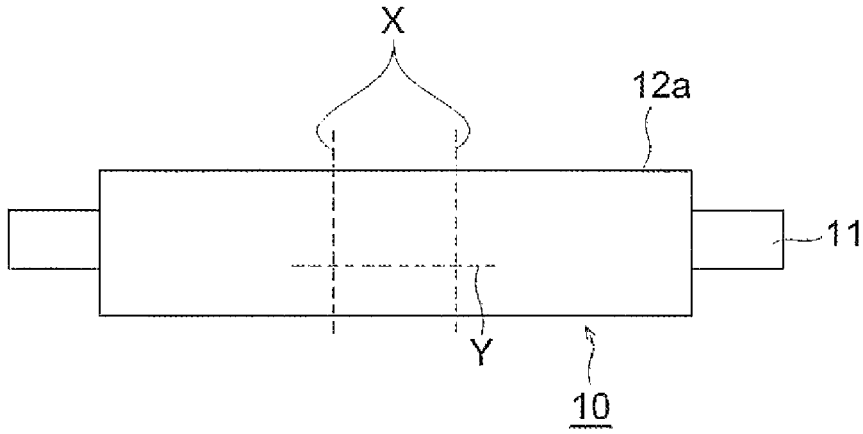
FIG. 2 shows a schematic drawing of a measuring device for measuring the peeling strength of the developing roller.
Figure 2:
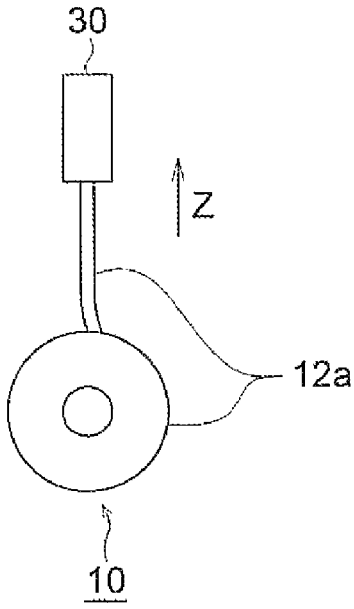

Cutting lines having a distance of 2.5 cm from each other along the circumference are made at the central portion of the resin layer 12 of a prepared developing roller as shown by broken lines X in FIG. 2(*a*) and further a cutting line is made in the shaft direction as shown by broken line Y, and the surface layer 12*a* is peeled off a little enforcedly. And then the peeled end portion of the surface layer 12*a* is lifted up in the perpendicular direction or the direction of arrow Z by a tensile tester 30, and the force necessary for beginning the peeling off of the surface layer 12*a* from the layer provided directly under the surface layer 12*b* is determined. Thus measured adhering force between layers is evaluated as the peeling resistive strength. Autograph AGS, manufactured by Shimadzu Seisakusho Co., Ltd., is employed as the tensile tester practically in this instance.

The lifting rate of the surface layer 12*a* is 100 mm/min and the value of loading is determined, at which the surface layer 12*a* can be lifted up without increasing the load in the course of raising the load by the loading capacity of 20 N.

The adhering force between the shaft and the layer directly provided on the shaft can be measured in the similar way as described above by peeling off a little enforcedly between the layers.

The electroconductivity of the developing roller can be evaluated by the volume resistivity (volume resistivity, volume resistive value). The volume resistivity can be measured by a know method.

In the invention, it is judged that the developing roller has suitable electroconductivity when the volume resistivity thereof is within the range of from $1\times10^1$ to $1\times10^8$ Ω·cm, and particularly preferably from $1\times10^2$ to $1\times10^6$ Ω·cm. The charge generated on the developing roller surface is suitably leaked and suitably inhibited when the volume resistivity of the developing roller is within the above range.

Figure 4:
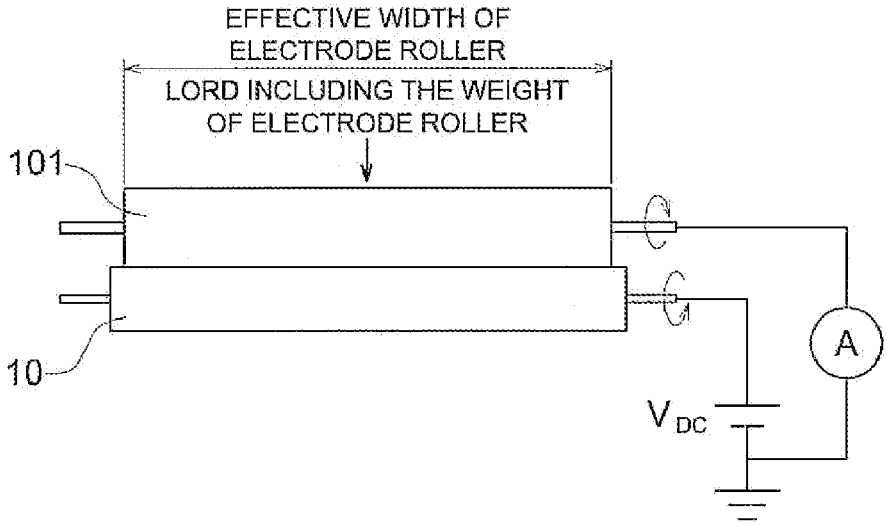
FIG. 4 shows a schematic drawing describing the measuring method for measuring the volume resistivity of the developing roller.

The volume resistivity of the developing roller can be measured by a metal roller electrode method typically using the apparatus shown in FIG. 4.

A stainless steel electrode roller 101 is contacted with the developing roller 10 and pressed at 9.8 N including the weight of the electrode roller 101, and a voltage of +100 volts is applied to an end of the developing roller and the voltage is changed to 2 volts after aging of 10 seconds, the electric current (I) is measured for 5 seconds by ampere meter A to obtain average current during 5 second with applied voltage of +2 volts. The volume resistivity R is calculated according to the following Formula 1.

$$R=V/I \qquad \text{Formula 1}$$

(Measuring Conditions)

Measuring environment: 23 C.°, 57% RH

Applying voltage (V): +2 V

Rotation number of roller: 27 rpm

Load to electrode roller: 9.8 N including the weight of the roller

Effective width of electrode roller: 230 mm (Diameter: 30 mm)

Measuring item: Electric current (I) (Average value for 5 seconds after applying the voltage of +2 volts)

Next, the production method of the developing roller of the invention is described below. In the production of the developing roller of the invention, a coating composition containing a material of resin-silica hybrid composite formed by condensation reaction of a resin having a functional group reactive to an epoxy group and the partial condensate of epoxy group-containing alkoxysilane is coated around the electroconductive shaft, and then subjected to a heating treatment to form a portion containing the resin-silica hybrid composite. After that, a coating composition containing the silicone copolymer is further coated on the above formed layer and dried and treated by heating to produce the developing roller according to the invention. The production procedure of the developing roller of the invention is further described below.

First, the resin layer forming material solution is prepared by dissolving materials for forming the resin layer around the electroconductive shaft. Inorganic and/or organic fine powder may be added according necessity into the resin layer forming solution. In such the case, the fine powder is in a dispersed state. In the invention, two kinds of solution are prepared, namely the resin layer forming solution for forming the portion containing the resin-silica hybrid composite and the resin layer forming solution for forming the portion containing the silicone copolymer.

Next, the resin layer forming solution was coated on the electroconductive shaft. The coating method can be selected according to the viscosity of the resin layer forming solution. Concretely, usual methods such as a dipping method, a spray method, a roller coating method and a brush coating method are applicable. The method is not specifically limited in the invention.

The coated layer is subjected to drying, and heating treatment at a temperature of from 120 to 200° C. and for a treating time of from 20 to 90 minutes to remove the solvent in the resin layer forming solution. Thus the resin layer is formed.

In the invention, the resin layer forming solution for forming the portion containing the resin-silica hybrid composite is coated on the electroconductive shaft and subjected to the heat treatment to form the layer containing the resin-silica hybrid composite. After that, the resin layer forming solution for forming the layer containing the silicone copolymer is further coated on the above formed layer and subjected to drying and heating treatment to produce the developing roller. The developing roller composed of the electroconductive shaft and the resin layer having the surface portion containing the silicone copolymer and the resin layer containing the resin-silica hybrid composite provided directly under the surface portion provided around the shaft can be obtained by such the production procedure.

The resin-silica hybrid composite contained in the resin layer 12 and the silicone copolymer are described in detail below.

First, the resin-silica hybrid composite contained as the principal component in the portion 12*b* of the resin layer 12 is described. The resin-silica hybrid composite has a structure in which a molecular bond is formed between a polymer chain constituting the resin component and an inorganic silica skeleton chain. Such the structure is formed by condensation reaction of a resin having a functional group reactive to an epoxy group and the partial condensate of epoxy group-containing alkoxysilane as the precursor of the silica skeleton. As examples of the resin having the functional group reactive to an epoxy group, a resin having a urethane group (polyurethane resin) and a resin composed of vinyl polymer are cited.

The content of the silica component in the resin-silica hybrid composite is preferably from 1.0% to 30.0% by weight. It is assumed that appropriate affinity is formed between silicon copolymer resin contained in the surface layer 12*a*, and strong adhesion force is formed between surface layer 12*a* when the silica content is within the above range.

The "resin having a functional group reactive to an epoxy group" for forming the resin-silica hybrid composite is described below.

Polyurethane resin is applicable as one of the resin having a functional group reactive to an epoxy group. The polyurethane resin is obtained by reaction of a polyvalent alcohol with a polyvalent isocyanate compound, which has a functional group reactive to an epoxy group in the molecule thereof.

The polyvalent alcohol has plural hydroxyl groups in the molecule, particularly preferably has the hydroxyl group at the terminal of the molecule. The polyvalent alcohol is preferably one so called as a polyol having a number average molecular weight (calculated in terms of styrene converted number average molecular weight by gel permeation chromatography) of approximately from 1,000 to 6,000 is preferable for giving suitable elasticity to the resin. As concrete examples of the polyol, a polyester polyol having an ester bond in the molecule, a polycarbonate polyol having a carbonate bond in the molecule, a polyether polyol having a ether bond in the molecule and a polyolefin polyol can be cited. These polyols each preferably have the above molecular weight for giving suitable dynamic property and elasticity to the formed resin. Among these polyols, the polyester polyol and polycarbonate polyol are preferable. The hybrid composite of silica and polyurethane resin formed by such the polyol has high durability.

The polyester polyol is obtained by dehydrating condensation reaction of the following glycols or ethers with a divalent carboxylic acid or a carboxylic acid anhydride. Concrete compounds to be used for preparing the polyester polyol usable in the invention are listed below. Various kinds of glycol such as diethylene glycol monocarboxylate, diethylene glycol, triethylene glycol, 1,2 propanediol, 1,3-propanediol, 1,4-butandiol, neopentyl glycol, pentanediol, 3-methyl-1,5-pentanediol, 3-methyl-1,5-pentanediol, 1,6-hexanediol, octanediol, 1,4-butinediol and dipropylene glycol is cited as the saturated or unsaturated glycol. An alkyl glycidyl ether such as n-butyl glycidyl ether and 2-ethylhexyl glycidyl ether, and a glycidyl ester of monocarboxylic acid such as glycidyl versatate are cited as the ethers. As the divalent carboxylic acid and the anhydride thereof, a dibasic acid such as adipic acid, maleic acid, fumaric acid, phthalic anhydride, isophthalic acid, terephthalic acid, succinic acid, oxalic acid, malonic acid, glutaric acid, pimelic acid, azelaic acid, sebacic acid and suberic acid, acid anhydrides each corresponding to the above acids and a dimer acid are cited, castor oil and the fatty acid thereof are also cited. Additionally to the polyester polyol obtained by dehydrating condensation of the above listed compounds, polyester polyols each obtained by ring-opening polymerization of cyclic ester compounds are usable.

The polycarbonate polyol is generally produced through a reaction such as de-methanol condensation reaction of a polyvalent alcohol and dimethyl carbonate, de-phenol condensation of a polyvalent alcohol and diphenyl carbonate, and de-ethylene glycol condensation reaction of a polyvalent alcohol and ethylene carbonate. A saturated or unsaturated glycol such as 1,6-hexanediol, diethylene glycol, propylene glycol, 1,3-butane diol, 1,4-butane diol, neopentyl glycol, pentanediol, 3-methyl-1,5-pentanediol, octanediol, 1,4-butinediol and dipropylene glycol, and an alicyclic glycol such as 1,4-dicyclohexane glycol and 1,4-cyclohexane-dimethanol are cited as the polyvalent alcohol to be used in these reactions.

Ethylene oxide, propylene glycol, propylene glycol and polyoxytetramethylene glycol each obtained by open-ring polymerizing ethylene oxide, propylene oxide and tetrahydrofuran, respectively, are cited as the polyether polyol.

As the polyvalent isocyanate compound constituting the polyurethane resin, aromatic, aliphatic and alicyclic isocyanate compounds are usable. Particularly, a diisocyanate is preferable for giving elasticity to the resin.

Concrete examples of the polyvalent isocyanate compound include 1,5-naphthylenediisocyanate, 4,4'-diphenylmethanediisocyanate, 4,4'-dibenzyl diisocyanate, dialkyldiphenylmethanediisocyanate, tetralkyldiphenyl-methanediisocyanate, 1,3-phenylenediisocyanate, 1,4-phenylenediisocyanate, tolylenediisocyanate, butane-1,4-diisocyanate, hexamethylenediisocyanate, isopropylenediisocyanate, methylenediisocyanate, 2,2,4-trimethylhexamethylenediisocyanate, 2,4,4-trimethylhexamethylenediisocyanate, cyclohexane-1,4-diisocyanate, xylenediisocyanate, hydrogenated xylylenediisocyanate, isophoronediisocyanate, lysine-diisocyanate, dicyclohexylmethane-4,4'-diisocyanate, 1,3-bis(isocyanatemethyl)-cyclohexane, methylcyclohexanediisocyanate, m-teramethylxylene diisocyanate, and a dimer diisocyanate compound formed by converting a carboxyl group of a dimer acid to an isocyanate group.

Furthermore, a compound so called as chain prolongation agent can be used for prolonging the molecular chain of the polyurethane resin. Concrete example of the chain prolongation agent include the glycols cited in the description as to the polyesterpolyol, glycols having a carboxyl group such as dimethylol propionic acid and dimethylol butanoic acid, and a polyamine such as ethylenediamine, propylenediamine, hexamethylenediamine, triethylenetetramine, diethylenetriamine, isopholonediamine, dicyclohexylmethane-4,4'-diamine and a dimerdiamine formed by converting a carboxyl group of a diner acid to an amino group, and a polyvalent amine containing a carboxyl group such as L-lysine and L-arginine. Particularly, a urea bond is formed in the molecular when the amines are used as the chain prolongation agent and interaction by hydrogen bond is caused by coexistence of the urea bond and the urethane bond in the molecule so as to raise the durability and adhesion of the resin layer. The amount of the urea bond is preferably from 1 to 10 mole-% to that of the urethane bond. Such the state can be realized by adding 99 to 90 mole-% of the glycol and 1 to 10 mole % of the amine on the occasion of reaction. It is supposed that suitable intermolecular interaction for improving the adhering ability can be obtained without repulsion between the urea bonds when the amount of the urea bond is within the above range.

A polymerization stopping agent can be used on the occasion of producing the polyurethane resin for controlling the molecular weight of the resin. Examples of the polymerization stopping agent include an alkylmonoamine such as di-n-butylamine and n-butylamine, a monoamine having a carboxyl group such as D-alanine and D-glutamic acid, an alcohol such as ethanol and isopropyl alcohol and an alcohol having a carboxyl group in the molecule thereof such as glycolic acid.

The polyurethane to be used in the invention has the functional group reactive to an epoxy group and the functional group may be positioned at the terminal or on the principal chain of the polyurethane. As concrete example of the functional group reactive to epoxy group, an acidic group such as a carboxyl group, a sulfonic acid group and a phosphoric acid group, an amino group, a hydroxyl group and a mercapto group are applicable, among them the acidic group and amino group are preferable from the viewpoint of reactivity to the epoxy group and the functional group providing ability.

The method for introducing the acidic group into the polyurethane molecule is not specifically limited and the functional group can be introduced, for example, by using a compound having the above functional group as the chain prolongation agent or the polymerization stopping agent. As the method for introducing the amino group into the polyurethane molecule, for example, a method in which a polyamine is made to react with the isocyanate group at the terminal of the prepolymer so that the amino group is made excess.

The amount of the epoxy reactive functional group in the polyurethane is preferably from 0.1 to 20 KOH mg/g. Suitable softness and heat resistivity and water resistivity are given to the resin-silica hybrid when the amount of the functional group is within the above range. The polyurethane having the urea bond in the molecule thereof is improved in the adhering ability.

The producing method of the polyurethane resin is described below. Typical producing method of the polyurethane resin usable in the invention includes a one-step method and a two-step method. In the one-step method, the polyurethane resin is produced by once reaction of the polyol, the diisocyanate compound, and the chain prolongation agent and, according necessity, polymerization stopping agent, in a suitable solvent. In the two-step method, a prepolymer having an isocyanate group at the terminal of the polyol is formed by reaction of the polyol and the diisocyanate compound in the presence of excessive amount of the cyanate group, and then the reaction is carried out in the presence of chain prolongation agent or polymerization stopping agent in a suitable solvent. The two-step method has a merit that a uniform polymer solution can be easily obtained.

As the solvent to be used on the occasion of producing the polyurethane resin, the following are usually cited: An aromatic solvent benzene, toluene and xylene; an ester type solvent such as ethyl acetate and butyl acetate; an alcohol type solvent such as methanol, ethanol, isopropanol, n-butanol and diacetone alcohol; a ketone type solvent such as acetone, methyl ethyl ketone and methyl isobutyl ketone; and dimethylformamide, dimethylacetamide, ethylene glycol dimethyl ether, tetrahydrofuran and cyclohexanone. These solvents can be used singly or in mixture of two or more kinds of them.

The vinyl polymer resin is described below, which is one of the resins having the functional group reactive to epoxy group. The vinyl polymer having the functional group reactive to epoxy group usable in the invention is typically one having the functional group reactive to epoxy group as a side chain thereof.

For example, a vinyl polymer comprising an acrylate or a methacrylate as a constituting monomer is cited as the vinyl polymer having the functional group reactive to epoxy group at the side chain. Such the vinyl polymer is a vinyl type monomer composed of an acrylate or a methacrylate as a constituting monomer. As concrete example of the functional group reactive to epoxy group, an acidic group such as a carboxyl group, a sulfonic acid group and a phosphoric acid group, an amino group, a hydroxyl group and a mercapto group are applicable, among them the acidic group and amino group are preferable from the viewpoint of reactivity to the epoxy group and the functional group providing ability.

Examples of the acrylate and methacrylate constituting the vinyl polymer usable in the invention as the monomer capable of reacting with the epoxy group include a hydroxyalkyl methacrylate such as 2-hydroxyethyl(meth)acrylate, 2-hydroxypropyl (meth)acrylate and 4-hydroxybutyl (meth)acrylate, a carboxylic acid such as (meth)acrylic acid, and an amine such as acrylamide. A monomer other than the above such as an alkyl acrylate, an alkoxyalkyl acrylate, an alkyl methacrylate and an alkoxyalkyl methacrylate are also applicable.

Examples of the alkyl acrylate include an alkyl ester having 1 to 6 carbon atoms such as methyl acrylate, ethyl acrylate, n-propyl acrylate, isopropyl acrylate, n-butyl acrylate, isobutyl acrylate, pentyl acrylate and hexyl acrylate. Examples of the alkyl methacrylate include an alkyl ester having 1 to 6 carbon atoms such as methyl methacrylate, ethyl methacrylate, n-propyl methacrylate, isopropyl methacrylate, n-butyl methacrylate, isobutyl methacrylate, butyl methacrylate, pentyl methacrylate and hexyl methacrylate. Examples of the alkoxyalkyl acrylate include methoxymethyl acrylate and ethoxyethyl acrylate, and examples of the alkoxyalkyl methacrylate include methoxymethyl methacrylate and ethoxyethyl methacrylate.

Among the above, the alkyl methacrylate is preferably used and methyl methacrylate, ethyl methacrylate and isobutyl methacrylate are particularly preferably used.

The partial condensate of epoxy group-containing alkoxysilane usable in the invention is described below. The resin-silica hybrid composite having the silica skeleton is contained in the resin layer provided directly under the surface layer of the developing roller. The silica skeleton constituting the resin-silica hybrid composite is formed by de-alcohol reaction of an epoxy compound with the partial condensate of alkoxysilane such as tetramethoxysilane.

The partial condensate of epoxy group-containing alkoxysilane is formed by de-alcohol reaction of an epoxy compound (A) with a partial condensate of alkoxysilane (B).

As to the epoxy compound (A) to be used for forming the partial condensate of epoxy group-containing alkoxysilane, number of epoxy group is not specifically limited as long as the compound is an epoxy compound having one hydroxyl group in the molecule thereof. The epoxy compound (A) lower in the molecular weight is higher in the compatibility with the partial condensate of alkoxysilane compound (B) and has effects to improve the thermal resistivity and adhesion. Concretely, ones having a carbon number of not more than 15 are reparable. For example, a monoglycidyl ether having one hydroxyl group at the terminal of molecule obtained by reaction of epichlorohydrin, water and a divalent alcohol or a phenol; a polyglycidyl ether having one hydroxyl group at the terminal of the molecule obtained by reaction of epichlorohydrin with a polyvalent alcohol of tri- or more-valent such as glycerol or pentaerythritol; an epoxy compound having one hydroxyl group at the terminal of the molecule obtained by reaction of epichlorohydrin with an aminomonoalcohol; and an alicyclic hydrocarbon monoepoxide having one hydroxyl group in the molecule such as tetrahydrobenzyl alcohol epoxide are usable. Among these epoxy compounds, glycidol is the most excellent in the heat resistivity donating ability and the reactivity with the partial condensate of alkoxysilane (B) is high.

As the partial condensate of alkoxysilane (B), one obtained by hydrolyzing a hydrolyzable alkoxysilane monomer represented by the following Formula (a) in the presence of an acid or an alkali solution and partially condensing is used.

$$R^1_pSi(OR^2)_{4-p} \qquad \text{Formula (a)}$$

In the formula, p is 0 or 1. $R^1$ is a lower alkyl group, an aryl group or an unsaturated aliphatic residue, each of which may have a functional group directly bonded to the carbon atom. $R^2$ is a methyl group or an ethyl group and plural groups represented by $R^2$ may be the same or different.

Concrete examples of the hydrolysable alkoxysilane monomer include a tetraalkoxysilane such as tetramethoxysilane, tetraethoxysilane, tetrapropoxysilane and tetraisopropoxysilane, and a trialkoxysilane such as methyltrimethoxysilane, methyltrimethoxysilane, methyltripropoxysilane, methyltributoxysilane, ethyltrimethoxysilane, ethyletriethoxysilane, n-propyltrimethoxysilane, n-propyltriethoxysilane, isopropyltrimethoxysilane and isopropyltriethoxysilane. As the alkoxysilane partial condensate (B), the above exemplified compounds can be used without any specific limitation. It is preferable that the ratio of the tetramethoxysilane to the whole alkoxysilane monomer amount is preferably not less than 70 mole-% when two or more kinds of the above mentioned are used.

The silica skeleton constituting the resin-silica hybrid composite is a reaction product of a resin with the epoxy group-containing alkoxysilane partial condensate formed from the above epoxy compound (A) and the alkoxysilane partial condensate (B). The ratio of the silica skeleton contained in the resin silica hybrid composite is preferably from 1.0 to 30% by weight. When the ratio is within the above range, stable adhesion with the surface layer can be maintained for a long period.

The alkoxysilane partial condensate (B) is, for example, ones having the structure represented by the following Formula (b) or (c).

Formula (b)

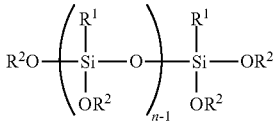

In the above formula, $R^1$ is a lower alkyl group, an aryl group or a unsaturated fatty acid residue, each of which may have a functional group directly bonded to the carbon atom. $R^2$ is a methyl group or an ethyl group and the plural groups represented by $R^2$ may be the same or different from each other. n is an average number of repeating units, 2-11.

Formula (c)

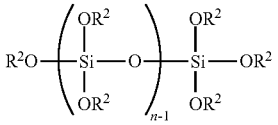

In Formula (c), $R^2$ is the same as $R^2$ in Formula (b).

Next, the silicone copolymer resin to be contained as the principal component in the surface part 12*a* of the resin layer 12 is described below. The resin layer 12 constituting the developing roller 10 according to the invention has a part 12*a* containing the silicone copolymer resin near the surface thereof. The silicone copolymer resin to be contained in the part near the surface is preferably one capable of forming a copolymer with a compound having a urethane bond or a vinyl copolymer though the silicone polymer resin is not specifically limited. n is an average number of repeating units, 2-11.

The silicone copolymer resin constituted with the compound having a urethane bond and that constituted with the vinyl polymer are described below.

The silicone polymer constituted with the compound having a urethane bond, hereinafter referred to as the silicone copolymerized urethane resin, can by synthesized from a compound having a silicone bond, two or more poly-valent isocyanate groups and two or more hydroxyl groups in the molecular thereof. Among such the resins, one having a hardness according to JIS A of from 60 to 90° and a 100% modulus of from $5\times10^6$ to $30\times10^6$ Pa is preferred.

One formed by the method, for example, disclosed in Japanese Examined Patent Publication (JP B) 7-33427 is preferable as the silicone copolymer resin, though the silicone polymer resin is not specifically limited. Namely, a polyurethane type resin having a copolymer component formed by a siloxane compound which has an active hydrogen atom at least a part of a polyol component and a caprolactam is particularly preferable among the polyurethane type resins formed by using a polyol component, an isocyanate component and, according to necessity, a chain propagation agent. As mentioned above, ones prepared by using the siloxane compound having an active hydrogen atom at least a part of the structure thereof and the polyol having a copolymer component of caprolactam can be exemplified as one of the polyurethane type resins usable in the invention.

The following compounds can be cited as the concrete examples of the siloxane compound containing the active hydrogen atom usable in the invention.

(1) Amino-Modified Siloxane Oil

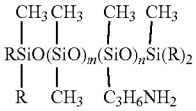

(m = 1 to 10, n = 2 to 10 and R = $CH_3$ or $OCH_3$)

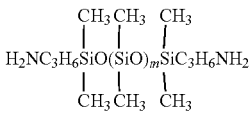

(m = 0 to 200)

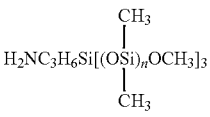

(n = 2 to 10)

-continued

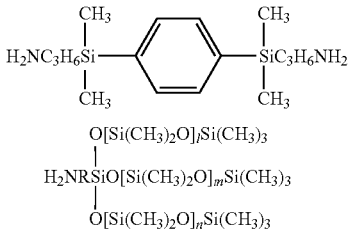

(Blanched point = 2 to 3,
R = a lower alkylele group,
l = 2 to 200, m = 2 to 200 and n = 2 to 200)

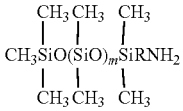

(n = 1 to 200 and R = a lower alkylene group)

(2) Epoxy-Modified Siloxane Oil

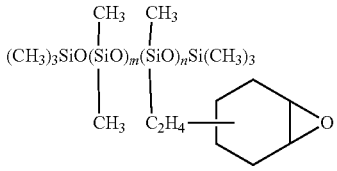

(m = 1 to 10, and n = 2 to 10)

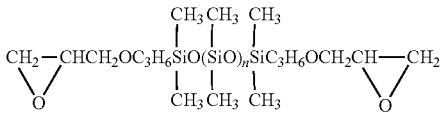

(n = 1 to 200)

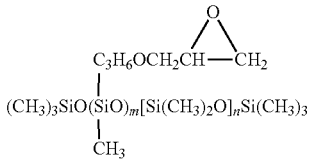

(m = 1 to 10, and n = 2 to 10)

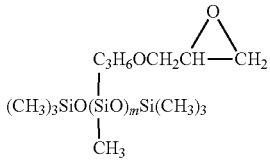

(m = 1 to 10)

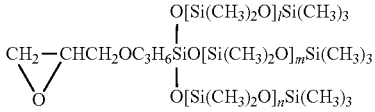

(Blanched point = 2 to 3, l = 2 to 200,
m = 2 to 200 and n = 2 to 200)

The above epoxy compounds can be made by reaction with a polyol, polyamine or dicarboxylic acid in a form having an active hydrogen atom at a terminal thereof.

(3) Alcohol-modified Siloxane Oil

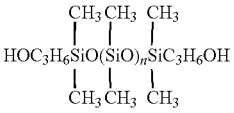

(n = 1 to 200)

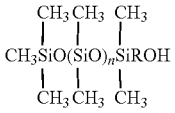

(n = 1 to 200 and R = a lower alkylene group)

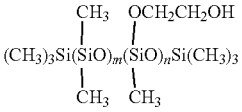

(m = 1 to 10 and n = 2 to 10)

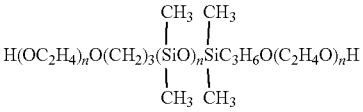

(n = 0 to 200)

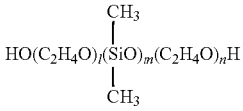

(l = 1 to 10, m = 10 to 200 and n = 1 to 5)

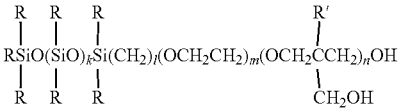

(R = a lower alkyl group,
R′ = a hydrogen atom or
a lower alkyl group, k = 1 to 250,
l = 0 to 5, m = 0 to 50 and n = 1 to 3)

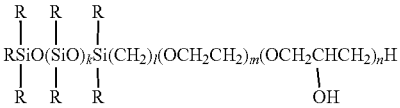

(R = a lower alkyl group, k = 1 to 250,
l = 0 to 5, m = 0 to 50 and n = 1 to 3)

(4) Mercapto-modified Siloxane Oil

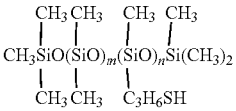

(m = 1 to 10 and n = 2 to 10)

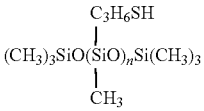

(n = 2 to 10)

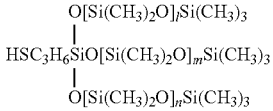

(Branched point = 2 to 3, l = 2 to 200,
m = 2 to 200 and n = 2 to 200)

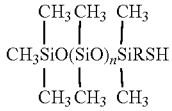

(n = 1 to 200 and R = a
lower alkylene group)

(5) Carboxyl-modified Siloxane Oil

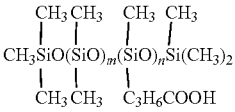

(m = 1 to 10 and n = 2 to 10)

-continued

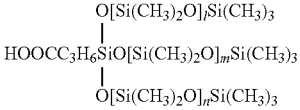

(Branched point = 2 to 3, l = 2 to 200,
m = 2 to 200 and n = 2 to 200)

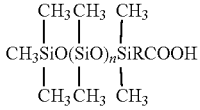

(m = 1 to 200 and R = a
lower alkylene group)

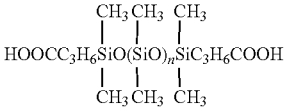

(n = 1 to 200)

The above active hydrogen-containing siloxane compounds are examples of the compounds usable in the invention and those usable in the invention is not limited to the above. In the above siloxane compounds, the mono-functional compound can be built in the polyurethane after copolymerization with caprolactone by reaction of the NOC group being at the terminal with polyurethane.

The ϵ-caprolactone capable of reacting with the active hydrogen-containing siloxane compound is represented by the following formula.

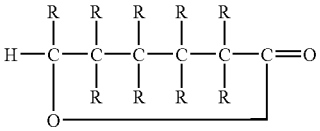

In concrete, a monoalkyl-ϵ-caprolactone such as ϵ-caprolactone, monomethyl-ϵ-caprolactone, monoethyl-ϵ-caprolactone, monopropyl-ϵ-caprolactone and monododecyl-ϵ-caprolactone are exemplified. Moreover, a dialkyl-ϵ-caprolactone, a trialkyl-ϵ-caprolactone, an alkoxy-ϵ-caprolactone such as ethoxy-ϵ-caprolactone, a cycloalkyl-ϵ-caprolactone, an aryl-ϵ-caprolactone and an aralkyl-ϵ-caprolactone are also cited.

The siloxane-modified polycaprolactone which is a copolymer of the siloxane compound and the caprolactone can be obtained by mixing the both compounds and making to react them by using suitable catalyst preferably under nitrogen gas stream for a time of from several to ten-odd hours at a temperature of from 150 to 200° C. The siloxane compound and the caprolactone can be made to react in an optional ratio and the ratio of from 10 to 80 parts by weight of the siloxane compound to 100 parts by weight of the caprolactam is preferable. The polyurethane type resin obtained in a ratio within the above range has high adhering ability and anti-blocking ability and high transparency.

An intermediate is also usable, which is obtained by reaction of the above copolymer with the later-mentioned polyisocyanate so as to remain at least one of the hydroxyl group and the isocyanate group. As concrete examples of such the intermediate, ones obtained by reaction of a bi-functional isocyanate group-rich copolymer with a multi-functional polyisocyanate and ones obtained by reaction of the reactive group-rich copolymer are cited.

Moreover, a polyester polyol obtained by reaction of the copolymer and the polycarboxylic acid is also usable.

Known polyols for polyurethane are cited as the polyol usable together with the siloxane-modified polycaprolactone copolymer. Preferable examples of such the compound include polyethylene adipate, polyethylenepropylene adipate, polyethylenebutylene adipate, polydiethylene adipate, polybutylene adipate, polyethylene succinate, polybutylene succinate, polyethylene sebacate, polytetramethylene ether glycol, poly-ε-caprolactonediol, polyhexamethylene adipate, polyol carbonate and polypropylene glycol each having a hydroxyl group as the terminal group and a molecular weight of from 300 to 4,000, and the above polyols each contain suitable amount of polyoxyethylene group in the molecule thereof.

4,4'-diphenylmethanediisocyanate (MDI), hydrogenated MDI, isophorone diisocyanate, 1,3-xylenediisocyanate, 1,4-xylenediisocyanate, 2,4-tolylenediisocyanate, 2,6-tolylenediisocyanate, 1,5-naphthalene diisocyanate, m-phenylenediisocyanate and p-phenylenediisocyanate are usable as the organic polyisocyanate, and urethane prepolymers each having a isocyanate group at the terminal thereof prepared by reaction of each the above diisocyanate compounds with a low molecular polyol or a polyamine are also usable.

As the chain propagating agent, known ones such as ethylene glycol, propylene glycol, diethylene glycol, 1,4-butanediol, 1,6-hexanediol, ethylenediamine, 1,2-propylenediamine, trimethylenediamine, tetramethylene diamine, hexamethylenediamine, decamethylenediamine, isophoronediamine, m-xylenediamine, hydrazine and water are usable.

Among the polyurethane type resins obtained from the above-mentioned materials, one in which the siloxane-caprolactone copolymer segment occupies about from 10 to 80% by weight in the polyurethane type resin molecule is particularly preferred. In such the resins, anti-sticking ability, anti-blocking ability, transparency and flexibility can be realized at the same time. One having a molecular weight of from 20,000 to 500,000 is preferable and one having a molecular weight of from 20,000 to 250,000 is more preferable.

The above copolymer is made to react with the polyisocyanate under an isocyanate-rich condition to form a polyurethane resin having at least one free isocyanate group and such the polyurethane can be used as a modifying agent for modifying another resin.

The polyurethane resin containing the above siloxane caprolactone copolymer segment can be produced by a known method. Such the polyurethane type resin can be prepared in a solvent or without solvent and the preparation in an organic solvent is advantageous since the obtained solution of the resin can be used without any treatment for various uses. Methyl ethyl ketone, methyl n-propyl ketone, methyl isobutyl ketone, diethyl ketone, methyl formate, ethyl formate, propyl formate, methyl acetate, ethyl acetate, butyl acetate, acetone, cyclohexanone, tetrahydrofuran, dioxane, methanol, ethanol, isopropyl alcohol, butanol, xylene, dimethylformamide, dimethylsulfoxide, methyl cellosolve and cellosolve acetate are usable as the organic solvent.

Silicone polymerized vinyl copolymer is described below. As a silicone type monomer usable in the method producing for the silicone type graft copolymer, linear silicone molecules having a (meth)acryl group at one of the terminals thereof are preferable. Among them, one having a number average molecular weight in terms of polystyrene according to gel permeation chromatography of from 1,000 to 100,000 can be used for sensitizing a silicone type macromonomer having a property derived from silicone such as slipping ability and without remaining of unreacted silicone.

As the production method of silicone type macromonomer, the following are applicable.

(1) Production Method Utilizing Anion Polymerization

A silicone living time is obtained by polymerizing a cyclic trisiloxane or a cyclic tetrasiloxane using a polymerization initiator such as lithium trialkylsilanolate. The living monomer is made to react with γ-methacryloyl oxypropylmonochlorodimethylsilane to produced the objective substance; cf. Japanese Patent Open to Public Publication (JP A) No. 59-78236.

(2) Production Method Utilizing Condensation Reaction

A production method of the macromonomer by reaction of a silicone having a silanol group at the terminal thereof with γ-methacryloyloxypropyltrimethoxysilane; cf. Japanese Patent Open to Public Publication (JP A) Nos. 58-167606 and 60-123518.

The radical polymerizable monomer to be polymerized with the silicone type macromonomer is a monomer for constituting the trunk polymer of the graft copolymer and one having a (meth)acryl type monomer selected from (meth) acrylates and (meth)acrylic acid as the principal component is preferable. Concretely, it is preferable that the content of the acryl type monomer in the trunk polymer is not less than 50% of the sum of the whole amount of the monomer units constituting the trunk polymer. The contacting ability of the coating layer can be obtained by making the content of the (meth)acryl type monomer unit in the trunk polymer to 50% or more by weight.

Examples of the (meth)acryl type monomer include an alkyl (meth)acrylate such as methyl (meth)acrylate, ethyl (meth)acrylate, n-propyl (meth)acrylate, n-butyl (meth)acrylate, isobutyl (meth)acrylate, t-butyl (meth)acrylate, 2-ethylhexyl (meth)acrylate, lauryl (meth)acrylate, stearyl (meth) acrylate and isobornyl (meth)acrylate, a hydroxyalkyl (meth) acrylate such as hydroxyethyl (meth)acrylate, hydroxypropyl (meth)acrylate and hydroxybutyl (meth)acrylate, an ethylene oxide-modified hydroxyl (meth)acrylate, a lactone-modified hydroxyl (meth)acrylate, acrylic acid and methacrylic acid.

Radical polymerizable monomers other than the above can be used according to necessity. Styrene, (meth)acrylonitrile, vinyl acetate, (meth)acrylamide, itaconic acid and maleic acid are cited as examples of such the monomer.

A bi-functional monomer, for example, an organic silicon monomer such as vinyltriethoxysilane and γ-methacryloxypropyltrimethoxysilane, allyl methacrylate and allyl phthalate can be used together with the above radical polymerizable monomer on the occasion of producing the graft copolymer, and the adding amount of it is less than the amount for occurring gelation.

An adding amount of the silicone type macromonomer in the radial polymerization for obtaining the graft copolymer is from 10 to 60%, and preferably from 20 to 40%, by weight of the whole amount of the monomer for forming the graft copolymer. When the adding amount of the silicone type macromonomer is within the above range, the graft copolymer having suitable slipping ability can be obtained and releasing of the silicone type macromonomer is not caused on the occasion of polymerization in the solvent system and storing of the graft copolymer.

As the polymerization initiator, a radical polymerization initiator of an azo compound is preferable usable even though the initiator is not specifically limited. Concretely, dimethyl-2,2'-azobisisobutylate, 1,1'-azobis-(1-acetoxy-1-phenylethane), 2,2'-azobis(2,4,4,-trimethyl-pentane), 2,2'-azobis(2-methylpropane), 2,2' azobis-2,4-dimethylvaleronitrile and 1,1'-azobis-1-cyclohexane carbonitrile are exemplified.

The adding amount of the polymerization initiator is preferably from 0.01 to 10%, and more preferably from 0.1 to 5%, by weight of the total amount of the polymerizable component. The temperature on the occasion of the polymerization is preferably from 50 to 150° C., and more preferably from 60 to 100° C. The polymerization time is preferably from 5 to 25 hours.

When the radical polymerization is performed by the solution polymerization method, a ketone type solvent such as acetone, methyl ethyl ketone and methyl isobutyl ketone, an acetate type solvent such as ethyl acetate and butyl acetate, cyclohexane, tetrahydrofuran, dimethylformamide, dimethylsulfoxide and hexamethylphosphoamide are cited as the usable solvent and the ketone type solvents and the acetate type solvents are more preferable. The above solvents are better solvent of silicone and the formed graft copolymer than another organic solvent and the remaining of unreacted silicone is a little.

The preferable average molecular weight of the graft polymer is from 50,000 to 500,000 in terms of weight average molecular weight of polystyrene by GCP measurement.

The polyurethane type resin superior in the anti-adhering ability, anti-blocking ability and flexibility, and excellent in the transparency can be provided by introducing the copolymer segment of the siloxane compound and caprolactone into the polyurethane type resin.

Next, the image forming method relating to the invention is described below. The developing roller according to the invention is preferably applied for an image forming apparatus using a non-magnetic single-component type developer for forming an image without use of any carrier.

The developing roller according to the invention is installed into a developing apparatus for supplying a toner onto an image carrier on which an electrostatic latent image is formed. The developing apparatus has a toner layer regulating member and a toner supply assisting member additionally to the developing roller and these parts are arrange so as to be touched with together. In the developing apparatus, a thin layer of toner is formed on the developing roller by the toner layer regulating member and the toner supply assisting member, and the toner layer is supplied on the image carrier for visualizing the latent image formed on the image carrier.

The toner layer regulating member supplied the toner in a state of a thin layer on the developing roller and contributes to triboelectrification of the toner. The toner layer regulation member is constituted by a material flexible in some degree such as urethane rubber and a metal plate and forms the thin layer of the toner by touching to the developing roller. The thin layer of the toner formed on the developing roller has a thickness of 10 times in the maximum and preferably not more than 5 times of the toner diameter.

The touching force of the toner layer regulating member to the developing roller is preferably from 100 mN/cm to 5 N/cm and particularly preferably from 200 mN/cm to 4 N/cm. When the touching force is within the above range, occurrence of image fault such as white lines can be avoided because toner transfer can be performed without unevenness. Moreover, the toner can be supplied onto the developing roller without deformation and fracturing of the toner by making the attaching force to be within the above range.

The toner supply assisting member is provided for stably supplying the toner onto the developing roller. As the toner supply assistant member, for example, a water wheel-shaped roller having stirring wings or a sponge roller is used. The size (diameter) of the toner supply assisting member is preferably from 0.2 to 1.5 times of that of the developing roller. The toner can be supplied neither too much nor too little by such the assisting member so that good images with no defect can be formed.

As the image carrier to be used for the image forming method relating to the invention, an inorganic photoreceptor, an amorphous silicon photoreceptor and an organic photoreceptor are usable. Among them, the organic photoreceptor is particularly preferable and a multiple layer structure having a charge transfer layer and a charge generation layer is preferred.

The developing apparatus applicable in the image forming method relating to the invention is concretely described below.

Figure 3:
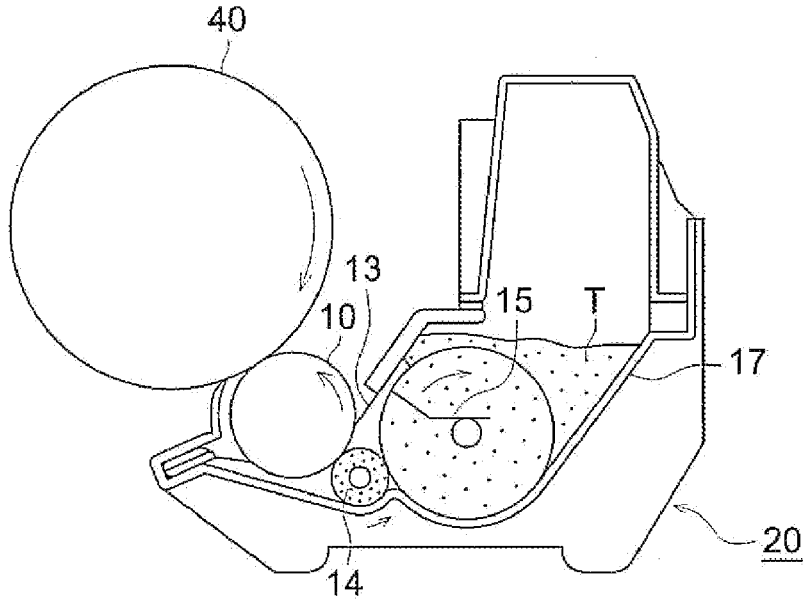
FIG. 3 shows a cross section of a developing apparatus in which the developing roller of the invention can be installed.

FIG. 3 shows a schematic cross section of a developing apparatus 20 applicable in the image forming method relating to the invention.

In FIG. 3, a non-magnetic toner T contained in a toner tank 17 is transferred and supplied by a stirring wing 15 as the toner supply assisting member onto a sponge roller 14 also as the toner supply assisting member. The toner transferred on the sponge roller is transferred onto a developing roller 10 by rotation on the sponge roller 14 in the direction of the arrow and static electrically and physically adsorbed onto the developing roller surface by the friction with the developing roller.

The toner adsorbed on the developing roller 10 is made to a uniform thin layer and charged by friction with the rotation of the developing roller 10 and an elastic blade 13 as the layer thickness regulating member. The toner thin layer formed on the developing roller 10 is supplied onto a photoreceptor drum 40 as the image carrier by contacting or non-contacting method to develop the latent image.

Besides, the constitution of the developing apparatus in which the developing roller relating to the invention can be installed is not limited to the shown in FIG. 3.

As the fixing method applicable in the image forming method relating to the invention, a fixing method so called as contact-heating method is cited, and the contact-heating method includes a heat-pressing fixing method, a heating roller fixing method, and a press-contact-heating fixing method carried out by a rotating pressing member interior of which a heater is fixedly provided.

In many cases of the heating roller fixing system, the fixing means is constituted by an upper roller constituted by a metal cylinder of iron or aluminum covered with terafluoroethylene or polytetrafluoroethylene-perfluoroalkoxyvinyl ether, in which a heat source is provided, and a lower roller constituted by silicone rubber. A typical upper roller has a line-shaped heater as the heating source and the surface thereof is heated at about a temperature of from 120 to 200° C. In the fixing portion, pressure is applied between the upper roller and the lower roller to form a portion so called as nipping porting by deforming the lower roller. The width of the nipping portion is from 1 to 10 mm and preferably from 1.5 to 7 mm. The line speed for the fixation is preferably from 40 mm/sec to 600 mm/sec. When the nipping width is too narrow, the toner is difficulty heated uniformly so as to cause uneven fixation, and when the nipping width is too wide, melting of the toner is accelerated so as to cause a problem of excessive occurrence of fixing offset.

Mechanism for cleaning the fixing apparatus may be used. A method by supplying silicone oil onto the upper fixing roller and a method in which cleaning is carried out by a pad, roller or web impregnated by silicone oil can be applied as the method for cleaning.

A method can be used in the invention, in which the fixation is carried out by a rotatable pressing member including a fixedly provided heater.

In such the method, the fixation is carried out by a fixedly provided heating member and a pressing member facing and contacting to the heating member for pressing and contacting the recording material to the heating member through a film.

The press-heating fixing apparatus is smaller in the heat capacity than that of usual heating roller and has a line-shaped heater in the direction at a right angles to the passing direction of the recording material. The maximum temperature of the heating portion is usually from 100 to 300° C.

The developer usable for image formation by the use of the developing roller relating to the invention is described below. The preferably employed developer is a single-component developer containing no carrier, and more preferably a non-magnetic single-component developer. As the toner to be used for image formation using the developing roller according to the invention, a fractured toner produced through fracturing and classifying processes or a polymerized toner directly produced by a polymerization process for forming resin particles are either usable. Among them, the polymerized toner is favorable for producing the toner constituted by fine and uniform particles because the diameter of the toner particle can be controlled in the producing process.

Formation of high resolution and high definition image can be easily carried out by the use of the small particle toner having uniform particle shape, and such the toner is particularly preferably for forming a pictorial full color image with high gradation reproducibility. It is expected that a high definition full color image can be stably formed by the combination of such the toner and the developing roller according to the invention.

Besides, the production method of the polymerized toner includes a process for coagulating the particles. Consequently, it is surmised that a slight amount of a coagulation agent used for coagulating the particles remains on the surface of the toner particles. It is solicitude that the remaining charge leaking effect of the developer roller surface is weakened by adhering of such the substance remaining on the surface of the toner particles to the developing roller.

However, it is confirmed by the later-mentioned results of examples that the remaining charge on the developing roller surface is not raised and image formation is suitably performed even when image formation is repeatedly carried out using the polymerized toner in the image forming apparatus using the foregoing developing roller.

Elements constituting the polymerized toner as an example of toner usable for image formation using the developing roller relating to the invention are described below.

(Monomer)

A radical polymerizable monomer is an essential component of the polymer and a crosslinking agent can be used according to necessity. It is preferable that the monomer contains at least one of a radical polymerizable monomer having the following acidic group or that having a basic group.

(1) Radical Polymerizable Monomer

Known radical monomers can be used as the radical polymerizable monomer without any limitation. The monomer may be used singly or in combination of two or more kinds thereof for satisfying required properties.

Concretely, an aromatic vinyl type monomer, a (meth) acrylate type monomer, a vinyl ester type monomer, a vinyl ether type monomer, a mono-olefin type monomer, a di-olefin type monomer and a halogenated olefin type monomer can be used.

Examples of the aromatic vinyl type monomer include a styrene type monomer such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n nonylstyrene, p-n-decylstyrene, p-n-dodecylstyrene, 2,4-dimethylstyrene, 3,4-dichlorostyrene, and a derivative thereof.

Examples of the (meth)acrylate type monomer include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate and diethylaminoethyl methacrylate.

Vinyl acetate, vinyl propionate and vinyl benzoate can be cited as the vinyl ester type monomer.

Vinyl methyl ether, vinyl ethyl ether, vinyl isobutyl ether and vinyl phenyl ether can be cited as the vinyl ether monomer.

Ethylene, propylene, isobutylene, isopropylene, isobutylene, 1-butene, 1-pentene and 4-methyl-1-pentene can be cited as the mono-olefin type monomer.

Butadiene, isoprene and chloroprene can be cited as the di-olefin type monomer.

Vinyl chloride, vinylidene chloride and vinyl bromide can be cited as the halogenated olefin type monomer.

(2) Crosslinking Agent

A radical polymerizable crosslinking agent may be added for improving properties of the toner. Examples of the radical polymerizable crosslinking agent include ones having two or more unsaturated bonds such as divinylbenzene, divinylnaphthalene, divinyl ether, diethyleneglycol methacrylate, ethyleneglycol dimethacrylate, polyethyleneglycol dimethacrylate and diallyl phthalate.

(3) Radical Polymerizable Monomer Having an Acidic Group or a Basic Group

As the radical polymerizable monomer having an acidic group or a basic group, for example, a carboxyl group-containing monomer, a sulfonic acid group-containing monomer, and an amine type compound such as a primary amine, a secondary amine, a tertiary amine and a quaternary ammonium salt are usable.

As the carboxyl group-containing radical polymerizable monomer, acrylic acid, methacrylic acid, fumaric acid, maleic acid, itaconic acid, cinnamic acid, monobutyl maleate and mono-octyl maleate can be cited.

As the sulfonic acid group-containing monomer, styrenesulfonic acid, allylsulfosuccinic acid and octyl allylsulfosuccinate can be cited.

The above monomers may be a salt of an alkali metal such as sodium and potassium or an alkali earth metal such as calcium.

Examples of the radical polymerizable monomer having a basic group include dimethylaminoethyl acrylate, dimethylaminoethyl methacrylate, diethylaminoethyl acrylate, diethylaminoethyl methacrylate and quaternary ammonium salts of the above four compounds, 3-dimethylaminophenyl acrylate, 2-hydroxy-3-methacryloxypropyltrimethylammonium salt, acrylamide, N-butylacrylamide, N,N-dibutylacrylamide, piperidylacrylamide, methacrylamide, N-butylmethacylamide, N-octadecylacrylamide, vinylpyridine; vinylpyrrolidone; vinyl-N-methylpyridinium chloride, vinyl-N-ethylpyridinium chloride, N,N-diallylmethylammonium chloride and N,N-diallylethylammonium chloride.

The radical polymerizable monomer having the acid group or that having the basic group is preferably used in an amount of from 0.1 to 15% by weight of the whole monomer and the radical polymerizable crosslinking agent is preferably used in an amount of from 0.1 to 10% by weight of the whole radical polymerizable monomer even though depending on the property thereof.

(Chain-Transfer Agent)

Usually used chain-transfer agent can be used for controlling the molecular weight.

As the chain-transfer agent, for example, octylmercaptan, dodecylmercaptane, tert-dodecylmercaptane, n-octyl-3-mercatopropionic acid ester, carbon tetrachloride and styrenedimer are usable without any limitation.

(Polymerization Initiator)

A radical polymerization initiator can be optionally used as long as that is water soluble, for example, a persulfate such as potassium persulfate and ammonium persulfate, and an azo type compound such as 4,4'-azobis-4-cyanovarelic acid and its salt and 2,2'-azobis(2-amidinopropane) salt, and a peroxide compound are usable.

The above radical polymerization initiator may be used as a redox type initiator by combining with a reducing agent according to necessity. The activity of the polymerization is raised, and lowering in the temperature and shortening in the time for polymerization are expected by the use of the redox initiator.

Any temperature may be applied for the polymerization as long as the temperature id higher than the lowest radical forming temperature, for example, a temperature within the range of from 50° C. to 90° C. is applied. However, the polymerization can be carried out at room temperature or higher a little than that by the use of a polymerization initiator capable of beginning polymerization at room temperature such as a combination of hydrogen peroxide and a reducing agent such as ascorbic acid.

For polymerizing the above radical polymerizable monomer, the monomer has to be dispersed into oil droplets in an aqueous medium using a surfactant. The surfactant to be used in the above occasion is not specifically limited and the following ionic surfactants can be exemplified as suitable ones.

Examples of the ionic surfactant include a sulfonic acid salt such as sodium dodecylbenzenesulfonate, sodium arylalkylpolyethersulfonate, sodium 3,3-disulfone-diphenylurea-4,4-diazo-bis-amino-8-naphthol-6-sulfonate, ortho-carboxybenzene-azo-dimethylaniline and sodium 2,2,5,5-tetramethyltriphenylmethane-4,4-diazo-bis-β-naphthol-6 sulfonate, a sulfate ester salt such as sodium dodecylsulfate, sodium tetradecylsulfate, sodium pentadecylsulfate and sodium octylsulfate, and a fatty acid salt such as sodium oleate, sodium laurate, sodium caprate, sodium caprylate, sodium capronate, potassium stearate and calcium oleate.

A Nonion surfactant can be also used. Concretely polyethylene oxide, polypropylene oxide, a combination of polypropylene and polyethylene oxide, an ester of polyethyleneglycol and a higher fatty acid, alkylphenolpolyethylene oxide, an ester of a higher fatty acid and polyethyleneglycol, an ester of higher fatty acid and polypropylene oxide and a sorbitan ester are usable. These surfactants are principally used as the emulsifying agent on the occasion of emulsifying polymerization, but they may be used in another process or another purpose.

(Colorant)

An inorganic pigment, an organic pigment and a dye can be used as the colorant.

Known inorganic pigments can be used as the inorganic pigment. Examples of the concrete inorganic pigment are described below.

As the black pigment, for example, carbon black such as furnace black, channel black, acetylene black, thermal black and lamp black and a magnetic powder such as magnetite and ferrite are usable.

These inorganic pigments can be used solely of in combination of plural kinds of them. The adding amount of the pigment is preferably from 2 to 20%, and more preferably from 3 to 15%, by weight of the polymer.

Known organic pigments and dyes can be used. Concrete organic pigments and dyes are listed below.

Examples of the red pigment include C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 52:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178 and C. I. Pigment Red 222.

Examples of orange or yellow pigment include C. I. Pigment Orange 31, C. I. Pigment Orange 43, C. I. Pigment Yellow 12, C. I. Pigment Yellow 13, C. I. Pigment Yellow 15, C. I. Pigment Yellow 17, C. I. Pigment Yellow 93, C. I. Pigment Yellow 94, C. I. Pigment Yellow 138, C. I. Pigment Yellow 180, C. I. Pigment Yellow 185, C. I. Pigment Yellow 155 and C. I. Pigment Yellow 156.

Examples of green or cyan pigment include C. I. Pigment Blue 15, C. I. Pigment Blue 15:2, C. I. Pigment Blue 15:3, C. I. Pigment Blue 16, C. I. Pigment Blue 60 and C. I. Pigment Green 7.

Examples of the dye include C. I. Solvent Red 1, C. I. Solvent Red 49, C. I. Solvent Red 52, C. I. Solvent Red 58, C. I. Solvent Red 63, C. I. Solvent Red 111, C. I. Solvent Red 122, C. I. Solvent Yellow 44, C. I. Solvent Yellow 77, C. I. Solvent Yellow 79, C. I. Solvent Yellow 81, C. I. Solvent Yellow 82, C. I. Solvent Yellow 93, C. I. Solvent Yellow 98, C. I. Solvent Yellow 103, C. I. Solvent Yellow 104, C. I. Solvent Yellow 112, C. I. Solvent Yellow 162, C. I. Solvent Blue 25, C. I. Solvent Blue 36, C. I. Solvent Blue 60, C. I. Solvent Blue 70, C. I. Solvent Blue 93 and C. I. Solvent Blue 95. A mixture of them is also usable.

These organic pigments and the dyes may be selected solely or in combination of plural kinds thereof according to necessity. The adding amount of the pigment is from 2 to 20%, and preferably from 3 to 15%, by weight of the polymer.

(Wax)

Wax may be contained in the toner particle in the polymerized toner. The structure and composition of the wax is not specifically limited. Low molecular weight polyolefin wax such as polypropylene and polyethylene, paraffin wax, Fischer-Tropsch wax and ester wax are usable.

The adding amount of the wax is from 1 to 30%, preferably from 2 to 20%, and more preferably from 3 to 15%, by weight of the whole toner.

The toner usable for image formation by the use of developing roller of the invention is preferably one prepared by a procedure that the monomer in which the wax is dissolved is dispersed in water and polymerized to form particles including the wax and the particles are salted out and fused with colored particles.

The toner usable in the invention is preferably produced by the polymerization method constituted by a process for dispersing a monomer liquid in which the wax is dissolved in an aqueous medium, a process for producing resin particles including the parting agent by the polymerization method, a process for fusing the rein particles in the aqueous medium of the above obtained particle dispersion, a process for separating the resultant particles from the aqueous medium by filtration and washing process for removing the surfactant from the filtered particles, a process for drying the obtained particles, and a process for adding an external additive. The resin particle may be a colored particle. A non-colored particle can be also used as the resin particle. In such the case, the colored particle is formed by adding a colorant particle dispersion to the resin particle dispersion and fused with together in the aqueous medium.

As the method for the fusion, a method is preferable, in which the resin particles prepared by the polymerization process is salted out/fused. When the non-colored resin particles are used, the resin particles and the colorant particles can be salted out/fused in the aqueous medium.

A toner constituting element other than the colorant and the parting agent such as charge controlling agent can be added in this process.

The aqueous medium is a medium principally constituted by water in a content of not less than 50% by weight. A water-soluble organic solvent such as methanol, ethanol, isopropanol, butanol, acetone, methyl ethyl ketone and tetrahydrofuran can be used other than water.

In a preferable polymerization method in the invention, the monomer solution in which the parting agent is dissolved is dispersed by applying mechanical energy into oil droplets in the aqueous medium containing the surfactant in a concentration of lower than the critical micelle concentration and the water soluble polymerization initiator to the resultant dispersion for performing the polymerization. In such the case an oil-soluble polymerization initiator may be added to the monomer.

The dispersing machine for dispersing the oil droplets is not specifically limited and, for example, CLEARMIX, a ultrasonic disperser, a mechanical homogenizer, Manton-Gaulin homogenizer and a pressure applying homogenizer are applicable.

As the foregoing, the colorant itself may be used after surface modification. The surface modification of the colorant is carried out by that the colorant is dispersed in a solvent and then a surface modifying agent is added and the temperature of the dispersion is raised for making reaction. After the reaction, the colorant is filtered, repeatedly washed and dried to obtain the pigment treated by the surface modifying agent.

The colorant particle is prepared by a method in which the colorant is dispersed in an aqueous medium. Such the dispersing treatment is carried out in water containing a surfactant in a concentration higher than the critical micelle concentration (CMC).

The dispersing machine to be applied for dispersing the pigment is not specifically limited, and CLEARMIX, a ultrasonic disperser, a mechanical homogenizer, a pressure applying homogenizer such as Manton-Gaulin homogenizer and a pressing disperser, and a medium using disperser such as a sand grinder, a Getzman mill and a diamond fine mill a preferably are preferably applied.

The foregoing surfactants can be also used as the surfactant in this process.

In the salting-out/fusing process, the salt-out agent composed of an alkali metal salt or an alkali-earth salt in a concentration higher than the critical coagulation concentration is added to the aqueous medium in which the resin particles and colorant particles are dispersed and then the system is heated by a temperature higher than the glass transition point of the resin particles for simultaneously progressing the salt-out and fusion of the particles.

In the alkali metal salt and the alkali-earth metal to be used as the salt-out agent, the alkali metal is, for example, lithium, potassium or sodium and the alkali-earth metal is, for example, magnesium, strontium or barium, and the form of the salt is, for example, chloride, bromide, iodide, carbonate or sulfate.

Materials capable of providing various functions may be added to the toner additionally to the resin, colorant and parting agent. Concrete example of such the material is a charge controlling agent. These materials can be added to the toner by various methods such as a method in which the materials are added together with the resin particles and the colorant particles on the stage of salt-out/fusion to be included in the toner and a method in which the materials are added to the resin particles themselves.

Known various charge controlling agents capable of being dispersed in water can be used. Concretely, a nigrosine dye, a metal salt of naphthenic acid or a higher fatty acid, an alkoxylated amine, a quaternary ammonium chloride, an azo metal complex, a metal salt of salicylic acid and a metal complex of them can be cited.

An additive so called as an external additive may be added to the toner of the invention for improving the fluidity, electrifying property and cleaning suitability. Various inorganic particles, organic particles and slipping agents are usable as the external additive without any limitation. Frequently, the particle before addition of the external additive is called as colored particle and the particle after the addition is called as toner or toner particle, however, both of them are referred to as toner or toner particle sometimes.

Known inorganic particles are usable as the external additive. Concretely, fine powders of silica, titania and alumina each having a number average primary particle diameter of 5 to 500 nm can be preferably used. These inorganic powders are preferably hydrophobic.

Concrete examples of the silica fine particle include R-805, R-976, R-974, R-972, R-812 and R-809, each manufactured by Nihon Aerosil Co., Ltd, HVK-2150 and H-200, each manufactured by Hoechst Co., Ltd., and TS-720, TS-530, TS-610, H-5 and MS-5, each manufactured by Cabot Co., Ltd. The above products are available on the market.

Concrete examples of the titania fine particle include T-805 and T-604, each manufactured by Nihon Aerosil Co., Ltd., MT-100S, MT-100B, MT-500BS, MT-600, MT-600SS and JA-1, each manufactured by Tayca Co., Ltd., TA-300SI, TA-500, TAF-130, TAF-510 and FAF-510T, each manufactured by Fuji Titan Co., Ltd., and IT-S, IT-OA, IT-OB and IT-OC, each manufactured by Idemitsu Kosan Co., Ltd. The above products are available on the market.

As the alumina fine particle, RFY-C and C-604, each manufactured by Nihon Aerosil Co., Ltd., and TTO-55, manufactured by Ishihara Sangyo Co., Ltd., are cited.

An organic fine spherical particle having a number average primary particle diameter of from about 10 to 2,000 nm can be used. Homo- or co-polymer of styrene and methyl methacrylate can be used as the material of the particle.

As the slipping agent, a metal salt of higher fatty acid such as a stearic acid salt of zinc, aluminum, copper, magnesium or calcium, a oleic acid salt of Zinc, manganese, iron, copper or magnesium, a salt of palmitic acid salt of zinc, copper, magnesium or calcium, a linolic acid salt of zinc, and a ricinoleic acid salt of zinc or calcium can be cited.

The adding amount of each of these external additives is preferably from 0.1 to 5% by weight.

A known mixing machine such as a tubular mixer, a Henschel mixer, a Nauter mixer and a V-type mixer are applied for addition of the external additives.

EXAMPLES

The embodiment of the invention is described below referring examples, but the invention is not limited to the examples.

1. Preparation of Developing Roller (1) Preparation of Resin-Silica Hybrid Composite-Containing Layer Forming Material 1 (Polyurethane Resin)

Into a reaction vessel having thereon a stirrer, a thermometer and a nitrogen gas introducing tube, 1,000 g of polycarbonate diol, PLACCEL CD220 manufactured by Daicel Chemical Industries, LTD., having a number average molecular weight of 2,000 and 278 g of isopholonediisocyanate were charged and made to react for 6 hours at 100° C. under nitrogen gas stream to form a prepolymer having a free isocyanate value of 3.44%. To the prepolymer, 548 g of methyl ethyl ketone was added to prepare a uniform solution of urethane prepolymer.

After that, 1,000 g of the above urethane prepolymer solution was added to a mixture composed of 71.8 g of isophoronediamine, 4.0 g of di-n-butylamine, 906 g of methyl ethyl ketone and 603 g of isopropyl alcohol, and made to react for 3 hours at 50° C. to obtain a polyurethane resin solution, hereinafter referred to as Polyurethane Resin (1A) solution. Thus obtained Polyurethane Resin (1A) solution had a resin solid component concentration of 30% and an amine value of 1.2 KOH mg/g.

On the other hand, into a reacting vessel having thereon a stirrer, a water separation device, a thermometer and a nitrogen gas introducing tube, 1,400 g of glycidol (Epiol OH manufactured by NOF Corporation) and 8957.9 g of a partial condensate of tetramethoxysilane having an average silicon atom number of 4 (Methyl silicate 51 manufactured by Tama Chemicals Co., Ltd.) were charged and heated by 90° C. while stirring under atmosphere of nitrogen gas stream. After that, 2.0 g of dibutyl tin dilaurate was added as a catalyst for performing reaction.

During the reaction, methanol was distilled out by the water separation device, and the reaction system was cooled when the distilled methanol amounted to 630 g. The time from the heating by 90° C. to cooling was 5 hours. After cooling, about 80 g of methanol remaining in the system was removed under reduced pressure by applying a pressure of 13 kPa for about 10 minutes. Thus Epoxy group-containing Alkoxysilane Partial Condensate (2A) was obtained.

Into a reaction vessel similar to the above, 500 g in terms of solid component of Polyurethane Resin (1A) solution was charged and heated by 50° C. and then 10.95 g of Epoxy Group-containing Alkoxysilane Partial Condensate (2A) was added and made to react for 4 hours at 60° C. under nitrogen gas stream to form Alkoxy Group-containing Silane Modified Polyurethane Resin 1.

To the above formed Alkoxy Group-containing Silane Modified Polyurethane Resin 1, urethane resin (Nippolan 5199 manufactured by Nippon Polyurethane Industry Co., Ltd.) was added and 30 parts by weight of Ketchen Black (carbon black) was mixed. Thus Resin-Silica Hybrid Composite-containing Layer Forming Material 1 was prepared.

The equivalent ratio 2A/1A of the equivalent of epoxy group of Epoxy Group-containing Alkoxysilane Partial Condensate (2A) to the equivalent of amino group of Polyurethane Resin (1A) was 2, and the content of Si in the solid component of the Alkoxy Group-containing Silane Modified Polyurethane Resin 1 was 3.3% in terms of the weight of silica.

(2) Preparation of Resin-Silica Hybrid-Containing Layer Forming Material 2 (Polyurethane Resin)

Polyurethane Resin (1B) solution was obtained in the same procedure as in the preparation of Resin-silica Hybrid Composite-containing Layer Forming Material 1 except that polyester polyol having a number average molecular weight of 2,000 (Kuraray Polyol P2010, manufactured by Kuraray Co., Ltd.) was used in place of the polycarbonate diol, PLACCEL CD220. Polyurethane Resin (1B) solution had a content of resin solid component of 30% and an amine value of 1.2 KOH mg/g.

Into the same reaction vessel as that used in the preparation of Resin-silica Composite-containing Layer Forming Material 1, 250.0 g glycidol and 2675.4 g of tetramethoxysilane partial condensate having an average silicon atom number of 10 (Methyl Silicate 56 manufactured by Tama Chemicals Co., Ltd.) were charged and heated by 90° C. while stirring under nitrogen gas stream atmosphere and made to react by adding 0.5 g of dibutyl tin dilaurate as a catalyst.

During the reaction, methanol was distilled out by the water separation device, and the reaction system was cooled when the distilled methanol amounted to 125 g. The time from the heating by 90° C. to cooling was 6.5 hours. After cooling, about 5 g of methanol remaining in the system was removed under reduced pressure by applying a pressure of 13 kPa for about 10 minutes. Thus Epoxy group-containing Alkoxysilane Partial Condensate (2B) was obtained.

Into the similar reaction vessel, 500 g in terms of solid component of the above Polyurethane Resin (1B) solution was charged and heated by 50° C., and then 17.75 g of the above Epoxy Group-containing partial condensate of alkoxysilane was added and made to react for 4 hours at 60° C. under nitrogen gas stream atmosphere to obtain Alkoxy Group-containing Silane-modified Polyurethane resin 2.

To the above formed Alkoxy Group-containing Silane-modified Polyurethane Resin 2, urethane resin (Nippolan 5199 manufactured by Nippon Polyurethane Industry Co., Ltd.) was added and 30 parts by weight of Ketchen Black (carbon black) was mixed. Thus Resin-Silica Hybrid Composite-containing Layer Forming Material 2 was prepared which contained 65% by weight of Alkoxy Group-containing Silane-modified Polyurethane Resin 2.

The equivalent ratio 2B/1B of the equivalent of epoxy group of Epoxy Group-containing Alkoxysilane Partial Condensate of (2B) to the equivalent of amino group of Polyurethane Resin (1B) was 2, and the content of Si in the solid component of the alkoxy group-containing silane-modified polyurethane resin was 6.0% in terms of the weight of silica.

(3) Preparation of Resin-Silica Hybrid-Containing Layer Forming Material 2 (Polyurethane Resin)

Into a similar reaction vessel to that used in preparation of Resin-silica hybrid-containing Layer Forming Material 1, 1,000 g of polycarbonate diol (PLACCEL CD220), and 278 g of isophorone diisocyanate were charged and made to react for 6 hours at 100° C. under nitrogen gas stream to form a prepolymer having a free isocyanate value of 3.44%. To the prepolymer, 548 g of methyl ethyl ketone was added for prepare a uniform solution of a urethane prepolymer.

One thousand grams of the uniform solution of prepolymer was added to a mixture of 77.6 g of isophoronediamine, 2.4 g of di-n-butylamine, 813 g of methyl ethyl ketone and 607 g of isopropyl alcohol and made to react for 3 hours at 50° C. to prepare Polyurethane Resin (1C) solution. Polyurethane Resin (1C) solution had a resin solid component concentration of 30% and an amine value of 2.4 KOH mg/g.

In the similar vessel, 500 g of Polyurethane Resin (1C) solution was heated by 50° C. and 18.54 g of Epoxy Group-containing Alkoxysilane Partial Condensate (2A), the same as that used in Resin-silica Hybrid Composite-containing Layer Forming Material 1, was added and made to react for 4 hours at 60° C. to obtain Alkoxy Group-containing Silane-modified Polyurethane Resin 3.

To the above formed Alkoxy Group-containing Silane-modified Polyurethane Resin 3, urethane resin (Nippolan 5199 manufactured by Nippon Polyurethane Industry Co., Ltd.) was added and 30 parts by weight of Ketchen Black (carbon black) was mixed. Thus Resin-Silica Hybrid Composite-containing Layer Forming Material 3 was prepared which contained 71% by weight of Alkoxy Group-containing Silane Modified Polyurethane Resin 3.

The equivalent ratio 2A/1C of the equivalent of epoxy group of Epoxy Group-containing Alkoxysilane Partial Condensate (2A) to the equivalent of amino group of Polyurethane Resin (1C) was 2, and the content of Si in the solid component of Alkoxy Group-containing Silane-modified Polyurethane Resin 3 was 6.4% in terms of the weight of silica.

(4) Preparation of Resin-Silica Hybrid Composite-Containing Layer Forming Material 4 (Polyurethane Resin)

Into a reaction vessel similar to that used for preparing Resin-Silica Hybrid Composite-containing Layer Forming Material 1, 1,000 g of polyesterpolyol (Kuraray Polyol P2010), 40 g of dimethylol butanoic acid, 342 g of isopholonediisocyanate were charged and made to react for 6 hours at 100° C. under nitrogen gas stream to prepare a prepolymer having a free isocyanate value of 3.28%. A uniform urethane prepolymer solution was prepared by adding 593 g of methyl ethyl ketone to thus obtained urethane prepolymer.

After that, 1,000 g of the above urethane prepolymer solution was added to a mixture composed of 59.7 g of isophoronediamine, 9.9 g of di-n-butylamine, 897 g of methyl ethyl ketone and 599 g of isopropyl alcohol and made to react for 3 hours at 50° C. to prepare Polyurethane Resin (1D) solution. Polyurethane Resin (1D) solution had a rein solid component concentration of 30% and an amine value of 3.0 KOH mg/g.

In a similar vessel, 500 g of Polyurethane Resin (1D) solution was heated by 50° C. and 18.54 g of Epoxy Group-containing Alkoxysilane Partial Condensate (2A) the same as that used in Resin-silica Hybrid Composite-containing Layer Forming Material 1 was added and made to react for 4 hours at 60° C. to obtain Alkoxy Group-containing Silane-modified Polyurethane Resin 4.

To the above formed Alkoxy Group-containing Silane-modified Polyurethane Resin 4, urethane resin (Nippolan 5199 manufactured by Nippon Polyurethane Industry Co., Ltd.) was added and 30 parts by weight of Ketchen Black (carbon black) was mixed. Thus Resin-Silica Hybrid Composite-containing Layer Forming Material 4 was prepared which contained 74% by weight of Alkoxy Group-containing Silane Modified Polyurethane Resin 4.

The equivalent ratio 2A/1D of the equivalent of epoxy group of Epoxy Group-containing Alkoxysilane Partial Condensate (2A) to the equivalent of amino group of Polyurethane Resin (1D) was 2, and the content of Si in the solid component of Alkoxy Group-containing Silane-modified Polyurethane Resin 4 was 7.8% in terms of the weight of silica.

(5) Preparation of Resin-Silica Hybrid Composite-Containing Layer Forming Material 5 (Vinyl Polymer Resin)

In a reaction vessel similar to that used in preparation of Resin-Silica Hybrid Composite-containing Layer Forming Material 1, 37.8 g of methyl methacrylate monomer and 16.2 g of methacrylic acid monomer were charged and the air in the system was replaced by nitrogen gas after sufficiently stirring. The system was heated by 95° C. and a solution composed of 1 g of azobisisobutyronitrile (AIBN) dissolved in 10 ml of methyl isobutyl ketone as a polymerization initiator was gradually added spending for 2 hours. The reacting liquid was further held at the same temperature for 3 hours to form Vinyl Polymer Resin 1 (1E).

In the similar reaction vessel, 500 g of the above Vinyl Polymer Resin (1E) was heated by 50° C. and then 18.54 g of Epoxy Group-containing Alkoxysilane Partial Condensate (2A) the same as that used in preparation of Resin-silica Hybrid Composite Layer Forming Material 1 was added and made to react for 4 hours at 60° C. under nitrogen gas stream to prepare Alkoxy Group-containing Silane-modified Vinyl Polymer Resin 5.

To the above formed Alkoxy Group-containing Silane-modified Polyvinyl Resin 5, acryl resin (ACRYPET VH, manufactured by Mitsubishi Rayon Co., Ltd.) was added and 30 parts by weight of Ketchen Black (carbon black) was further mixed. Thus Resin-Silica Hybrid Composite-containing Layer Forming Material 5 was prepared which contained 64% by weight of Alkoxy Group-containing Silane-modified polyvinyl Resin 5.

The equivalent ratio 2A/1E of the equivalent of epoxy group of Epoxy Group-containing Alkoxysilane Partial Condensate (2A) to the equivalent of carboxyl group of Polyvinyl Resin (1E) was 2, and the content of silicon in the solid component of Alkoxy Group-containing Silane-modified Polyvinyl Resin 5 was 7.8% in terms of the weight of silica.

(6) Preparation of Silicone Copolymerized Urethane Resin-Containing Layer Forming Material 1

Into a reaction vessel having thereon a stirrer, a thermometer, a nitrogen gas introducing tube and a reflux condenser, 310 parts of ε-caprolactam, 150 parts of an alcohol-modified siloxane oil, Exemplified Compound 3-3, and 0.05 parts of tetrabutyl titanate were charged and made to react for 10 hours at 180° C. under nitrogen gas stream to prepare Polysiloxane-polyester Copolymer 1. Thus formed Polysiloxane-polyester Copolymer 1 had a hydroxyl group value of 37, an acid value of 0.40 and a number average molecular weight of 3,030.

One hundred and fifty parts of the above copolymer and 27 parts of 1,4-butanediol were dissolved in a mixed solvent composed of 200 parts of methyl ethyl ketone and 100 parts of dimethylformamide and a mixture composed of 91 parts of hydrogenated diphenylmethanediisocyanate, hereinafter also referred to hydrogenated MDI, dissolved in 188 parts of dimethylformamide was gradually dropped into the above liquid. After completion of the dropping, reaction was made for 6 hours at 80° C. to prepare Silicone Copolymerized Urethane Resin 1 solution. Thus formed Silicone Copolymerized Polyurethane Resin 1 solution had transparency, a solid component concentration of 35% and a viscosity at 25° C. of 35.5 Pa·s.

Silicone Copolymerized Polyurethane Resin 1 was mixed with urethane resin (Nippolan 5199 manufactured by Nippon Polyurethane Industry Co., Ltd.) and 30 parts by weight of Ketchen Black (carbon black) was further mixed. Thus Silicone Copolymerized Polyurethane Resin-containing Layer Forming Material 1 was prepared, which contained 54% by weight of Silicone Copolymerized Polyurethane Resin 1.

(7) Preparation of Silicone Copolymerized Polyurethane Resin-Containing Layer Forming Material 2

In a solvent mixture composed of 200 parts of methyl ethyl ketone and 150 parts of dimethylformamide, 75 parts of the above Polysiloxane-polyester Copolymer 1, 75 parts of polybutylene butylate having a hydroxyl group value of 56.0, an acid value of 0.40 and a number average molecular weight of 2,000, and 27 parts of 1,4-butanediol were dissolved and a mixture composed of 90 parts of hydrogenated MDI dissolved in 146 parts of dimethylformamide was gradually dropped into the above solution while sufficiently stirred at 60° C. After completion of the dropping, reaction was made for 6 hours at 80° C. to prepare Silicone Copolymerized Polyurethane Resin 2 solution. Thus formed Silicone Copolymerized Polyurethane Resin 2 solution had transparency, a solid component concentration of 35% and a viscosity of 31.2 Pa·s.

Silicone Copolymerized Polyurethane Resin 2 was mixed with urethane resin (Nippolan 5199 manufactured by Nippon Polyurethane Industry Co., Ltd.) and 30 parts by weight of Ketchen Black (carbon black) was further mixed. Thus Silicone Copolymerized Polyurethane Resin-containing Layer Forming Material 2 was prepared, which contained 60% by weight of Silicone Copolymerized Polyurethane Resin 2.

(8) Preparation of Silicone Copolymerized Polyurethane Resin-Containing Layer Forming Material 3

Into a reaction vessel having thereon a stirrer, a thermometer, a nitrogen gas introducing tube and a reflux condenser, 166 parts of s-caprolactam, 150 parts of alcohol-modified siloxane oil (Exemplified Compound 3-6) and 0.04 parts of tetrabutyltitanate were charged and made to react for 10 hours at 180° C. under nitrogen gas stream to form Polysiloxane-polyester Copolymer 2. Thus formed Polysiloxane-polyester copolymer 2 had a hydroxyl group value of 28, an acid value of 0.35 and a number average molecular weight of 4,010.

One hundred and fifty parts of the above copolymer and 27 parts of 1,4-butanediol were dissolved in a solvent mixture composed of 200 parts of methyl ethyl ketone and 100 parts of dimethylformamide and a mixture composed of 88 parts of hydrogenated MDI dissolved in 192 parts of dimethylformamide was gradually dropped into the above solution while sufficiently stirred at 60° C. After completion of the dropping, reaction was made for 6 hours at 80° C. to prepare Silicone Copolymerized Polyurethane Resin 3 solution. Thus formed Silicone Copolymerized Polyurethane Resin 3 solution had transparency, a solid component concentration of 35% and a viscosity at 25° C. of 31.2 Pa·s.

Silicone Copolymerized Polyurethane Resin 3 was mixed with urethane resin (Nippolan 5199 manufactured by Nippon Polyurethane Industry Co., Ltd.) and 30 parts by weight of Ketchen Black (carbon black) was further mixed. Thus Silicone Copolymerized Polyurethane Resin-containing Layer Forming Material 3 was prepared, which contained 70% by weight of Silicone Copolymerized Polyurethane Resin 3.

(9) Preparation of Silicone Copolymerized Polyurethane-Containing Layer Forming Material 4

Seventy five parts of the copolymer used in the above Layer Forming Material 3 and 75 parts of polyethylene adipate having a hydroxyl group value of 56.0, an acid value of 0.28 and a number average molecular weight of 2,000, and 27 parts of 1,4-butanediol were dissolved in a solvent mixture composed of 200 parts of methyl ethyl ketone and 150 parts of dimethylformamide, and a mixture composed of 93 parts of MDI dissolved in 151 parts of dimethylformamide was gradually dropped into the above solution while sufficiently stirred at 60° C. After completion of the dropping, reaction was made for 6 hours at 80° C. to prepare Silicone Copolymerized Polyurethane Resin 4 solution. Thus formed Silicone Copolymerized Polyurethane Resin 4 solution had transparency, a solid component concentration of 35% and a viscosity at 25° C. of 40.5 Pa·s.

Silicone Copolymerized Polyurethane Resin 4 was mixed with urethane resin (Nippolan 5199 manufactured by Nippon Polyurethane Industry Co., Ltd.) and 30 parts by weight of Ketchen Black (carbon black) was further mixed. Thus Silicone Copolymerized Polyurethane Resin-containing Layer Forming Material 4 was prepared, which contained 75% by weight of Silicone Copolymerized Polyurethane Resin 4.

(10) Preparation of Silicone Copolymerized Vinyl Copolymer Resin-Containing Layer Forming Material 5

Into a flask having thereon a stirrer, a thermometer and a nitrogen gas introducing tube, 20 parts of silicone type macromonomer (FM0275 manufactured by Chisso Corporation) 60 parts of methyl methacrylate, 10 parts of butyl methacrylate, 5 parts of 2-hydroxyethyl methacrylate, 5 parts of methacrylic acid, 1.5 parts of dimethyl-2,2'-azobis-isobutylate (MAIB) as a polymerization initiator and 100 parts of methyl ethyl ketone as a solvent were charged and made to react for 6 hours at 70° C. while bubbling nitrogen gas to synthesize Silicone Type Graft Copolymer Resin having a solid component content of 50%.

Thus formed Silicone Type Graft Copolymer Resin was mixed with acryl resin (ACRYPET VH manufactured by Mitsubishi Rayon Co., Ltd.) and 30 pats of Ketchen Black (carbon black) was further mixed. Thus Silicone Copolymerized Polyurethane Resin-containing Layer Forming Material 5 was prepared, which contained 59% by weight of Silicone Type Graft Copolymer Resin.

(11) Preparation of Developing Roller (a) Preparation of Developing Roller 1

Resin-silica Hybrid Composite-containing Layer Forming Material 1 was coated in a thickness of 15 μm on the circumference surface of a shaft made from SUS 303 having a diameter of 10 mm, and heated for 1 hour at 100° C. to form a layer which contained 52% by weight of the polyurethane resin-silica hybrid composite. Then Silicone Copolymerized Polyurethane Resin-containing Layer Forming Material 1 was coated in a thickness of 15 μm and heated for 1 hour at 100° C. to form a surface layer which contained 54% by weight of the silicone copolymerized polyurethane resin layer. Thus Developing Roller 1 was prepared.

(b) Preparation of Developing Roller 2

A layer containing 65% by weight of the polyurethane resin-silica hybrid composite was formed in the same procedure in the preparation of Developer Roller 1 except that Resin-Silica Hybrid Composite Resin-containing Layer Forming Material 2 was coated in a thickness of 10 μm in place of Resin-Silica Hybrid Composite Resin-containing Layer Forming Material 1 in the preparation of Developing Roller 1. Then Developing Roller 2 having a surface layer containing 60% by weight of the silicone copolymerized polyurethane resin was prepared in the same procedure as in Developing Roller 1 by using Silicone Copolymerized Polyurethane Resin-containing Layer Forming Material 2 in place of Silicone Copolymerized Polyurethane Resin-containing Layer Forming Material 1.

(c) Preparation of Developing Roller 3

A layer containing 71% by weight of the polyurethane resin-silica hybrid composite was formed in the same procedure as in the preparation of Developer Roller 1 except that Resin-Silica Hybrid Composite Resin-containing Layer Forming Material 3 was coated in a thickness of 12 μm in place of Resin-Silica Hybrid Composite Resin-containing Layer Forming Material 1 in the preparation of Developing Roller 1. Then Developing Roller 3 having a surface layer containing 70% by weight of the silicone copolymerized polyurethane resin was prepared in the same procedure as in Developing Roller 1 by using Silicone Copolymerized Polyurethane Resin-containing Layer Forming Material 3 in place of Silicone Copolymerized Polyurethane Resin-containing Layer Forming Material 1.

(d) Preparation of Developing Roller 4

A layer containing 74% by weight of the polyurethane resin-silica hybrid composite was formed in the same procedure in the preparation of Developer Roller 1 except that Resin-Silica Hybrid Composite Resin-containing Layer Forming Material 4 was in place of Resin-Silica Hybrid Composite Resin-containing Layer Forming Material 1 in the preparation of Developing Roller 1. Then Developing Roller 4 having a surface layer containing 75% by weight of the silicone copolymerized polyurethane resin was prepared in the same procedure as in Developing Roller 1 by using Silicone Copolymerized Polyurethane Resin-containing Layer Forming Material 4 in place of Silicone Copolymerized Polyurethane Resin-containing Layer Forming Material 1.

(e) Preparation of Developing Roller 5

A layer containing 64% by weight of the vinyl resin-silica hybrid composite was formed in the same procedure in the preparation of Developer Roller 1 except that Resin-Silica Hybrid Composite Resin-containing Layer Forming Material 5 was used in place of Resin-Silica Hybrid Composite Resin-containing Layer Forming Material 1 in the preparation of Developing Roller 1. Then Developing Roller 5 having a surface layer containing 59% by weight of the silicone copolymerized vinyl polymer resin was prepared in the same procedure as in Developing Roller 1 by using Silicone Copolymerized Polyurethane Resin-containing Layer Forming Material 5 in place of Silicone Copolymerized Polyurethane Resin-containing Layer Forming Material 1.

(f) Preparation of Comparative Developing Roller 1

Comparative Developing Roller 1 was prepared in the same procedure as in Developing Roller 1 except that a layer was formed on the shaft surface by coating bis-1,2-triethoxysilylethane in place of Resin-Silica Hybrid Composite-containing Layer Forming Material 1 and heating for 1 hour at 100° C.

(g) Preparation of Comparative Developing Roller 2

One hundred parts of urethane resin (Nippolan 5199 manufactured by Nippon Polyurethane Industry Co., Ltd.) 30 parts of Ketchen Black, 40 parts of an urethane resin particle (Vurnock CFB 100 manufactured by Dainippon Ink And Chemicals, Inc.) and 400 parts of methyl ethyl ketone were dissolved and dispersed to prepare Comparative Surface Layer Forming material 1.

Comparative Developing Roller 2 was prepared in the same procedure as in Developer Roller 1 except that Comparative Surface Layer Forming Material 1 was used in place of Silicone Copolymerized Polyurethane Resin-containing Layer Forming Material 1.

2. Preparation of Toner (1) Preparation of Resin Particle Dispersion 1

In a flask having thereon a stirrer, 72.0 g of pentaerythritol tetrastearate was added to a monomer mixture composed of 115.1 g of styrene, 42.0 g of n-butyl acrylate and 10.9 g of methacrylic acid and dissolved by heated by 80° C.

On the other hand, a surfactant solution prepared by dissolving 7.08 g of an anionic surfactant of sodium dodecylbenzenesulfonate (SDS) in 2,769 g of deionized water was charged into a separable flask having thereon a stirrer, a thermo sensor, a cooling pipe and a nitrogen introducing tube and heated by 80° C. while stirring at a stirring rate of 230 rpm under nitrogen gas stream. Then the above monomer solution (80° C.) was mixed and dispersed in the surfactant solution by a mechanical dispersing machine, CLEARMIX manufactured by M-Tech Co., Ltd., having a circulation pass to prepare a dispersion in which emulsified particles (oil droplets) having uniform particle diameter.

To the above dispersion, an initiator solution prepared by dissolving 0.84 g of a polymerization initiator, potassium persulfate (KPS) in 200 g of deionized water was added of and the system was heated and stirred for 3 hours at 80° C. for performing polymerization reaction. To resultant dispersion, a solution prepared by dissolving 7.73 g of polymerization initiator (LPS) in 240 g of deionized water was added, and after 15 minutes the temperature was adjusted to 80° C. Then a mixture of 383.6 g of styrene, 140.0 g of n-butyl acrylate, 36.4 parts of methacrylic acid and 12 g of n-octylmercaptan was dropped into the above dispersion spending 100 minutes. This system was heated and stirred for 60 minutes at 80° C. and then cooled by 40° C. to prepare Resin Particle Dispersion 1.

(2) Preparation of Colorant Dispersion K

Nine point 2 grams of sodium n-dodecylsulfate was dissolved in 160 g of deionized water. To the solution, 20 g of carbon black (Mogal L, manufactured by Cabot Co., Ltd.) was gradually added as a colorant and dispersed by a mechanical dispersing machine CLEARMIX, manufactured by M-Tech Co., Ltd., to prepare Colorant Dispersion K. The particle diameter of the colorant in Colorant Dispersion K measured by an electrophoretic light scattering photometer ELS-800, manufactured by Otsuka Electronics Co., Ltd., was 120 nm.

(3) Preparation of Colored Particle 1K

Into a reaction vessel (four-mouth flask) to which a thermal sensor, a cooling pipe, a stirrer (two wings, crossing of 20°) and a shape monitoring apparatus were attached 1250 g in terms of solid component of Resin Particle 1, 2,000 g of deionized water and whole of Colorant Dispersioin 1 were charged and the interior temperature was adjusted to 25° C. After that, a 5 moles/liter sodium hydroxide solution was added to the resultant dispersion for adjusting the pH to 10.0. Then an aqueous solution composed of 52.6 g of magnesium chloride hexahydrate dissolved in 72 g of deionized water was added into the reaction vessel spending 10 minutes while stirring at 25° C. Just after completion of the addition, the system was heated by 95° C. spending for 5 minutes at a rising rate of 14° C./minute.

In such the situation, the diameter of coagulated particle was measured by Multisizer 3, manufactured by Beckman-Coulter Co., Ltd., and a solution composed of 115 g of sodium chloride and 700 g of deionized water was added to stop growing the particle when the volume based median diameter (D50v) of the particle was reached 6.5 μm. After that, the dispersion was further heated and stirred at a stirring rotation speed of 120 rpm for 8 hours at 90° C. for ripening treatment to continue fusion of the particle. The system was cooled by 30° C. at a cooling rate of 10° C./minute and the pH of that is adjusted to 3.0 and then stirring was stopped.

Thus formed particles were repeatedly washed by deionized water, classified in liquid by a centrifuging machine and dried by a flush jet dryer to prepare Colored Particle K1 having a moisture content of 3.0.

(4) Preparation of Colorant Dispersion Y

Colorant Dispersion Y was prepared in the same procedure as in Colorant Dispersion K except that 20 g of the carbon black was replaced by 20 g of C. I. Pigment Yellow 74. The diameter of colorant particle in Colorant Dispersion Y measured by the electrophoretic light scattering photometer ELS-800, manufactured by Otsuka Electronics Co., Ltd., was 120 nm in weight average particle diameter.

(5) Preparation of Colorant Dispersion M

Colorant Dispersion M was prepared in the same procedure as in Colorant Dispersion K except that 20 g of the carbon black was replaced by 20 g of a quinacridone type magenta pigment C. I. Pigment Red 122. The diameter of colorant particle in Colorant Dispersion M measured by the electrophoretic light scattering photometer ELS-800, manufactured by Otsuka Electronics Co., Ltd., was 120 nm in weight average particle diameter.

(6) Preparation of Colorant Dispersion C

Colorant Dispersion M was prepared in the same procedure as in Colorant Dispersion K except that 20 g of the carbon black was replaced by 20 g of a phthalocyanine type pigment C. I. Pigment Blue 15:3. The diameter of colorant particle in Colorant Dispersion C measured by the electrophoretic light scattering photometer ELS-800, manufactured by Otsuka Electronics Co., Ltd., was 120 nm in weight average particle diameter.

(7) Preparation of Colored Particle 1Y

Colored Particle 1Y was prepared in the same procedure as in Colored Particle 1K except that the whole amount of Colorant Dispersion K was replaced by the whole amount of Colorant Dispersion Y.

(8) Preparation of Colored Particle 1M Colored Particle 1M was prepared in the same procedure as in Colored Particle 1K except that the whole amount of Colorant Dispersion K was replaced by the whole amount of Colorant Dispersion M.

(9) Preparation of Colored Particle 1C

Colored Particle 1C was prepared in the same procedure as in Colored Particle 1K except that the whole amount of Colorant Dispersion K was replaced by the whole amount of Colorant Dispersion C.

(10) Preparation of Toner

The above toners were each mixed with 0.8 parts by weight of hydrophobic silica having a number average primary particle diameter of 12 nm and a hydrophobicity of 65 and hydrophobic titania having a number average primary particle diameter of 30 nm and a hydrophobicity of 55 by a Henschel mixer to prepare toners. The toners were each referred to as Toner 1K, Toner 1Y, Toner 1M and Toner 1C, respectively.

3. Evaluation Experiment (1) Evaluation of Adhering Ability (Peeling Off Strength) of Developing Roller Two cutting lines having a distance of 2.5 cm from each other along the circumference were made at the central portion of the resin layer of the above prepared developing roller as shown by broken lines X in FIG. 2(*a*), and further a cutting line was made in the shaft direction as shown by broken line Y, and the surface layer was peeled off a little enforcedly with a cutter at the cutting line shown by broken line Y as shown in FIG. 2(*b*). And then the peeled end portion of the surface layer was lifted up in the perpendicular direction or the direction of arrow Z by a tensile tester 30, (Autograph AGS, manufactured by Shimadzu Seisakusho Co., Ltd.), and the force necessary for beginning the peeling off of the surface layer was determined for evaluation. The lifting rate of the surface layer was 100 mm/minute. Samples requiring a load for beginning the peeling off the resin layer of not less than 4.0 N were judged as acceptable.

(2) Evaluation of Image

A color laser printer Magicolor 2300DL, manufactured by Konica Minolta Business Technology Co., Ltd., available on the market was used for evaluation. The above prepared developing rollers were each installed in the developing device of the above printer for evaluation. An object having a pixel ratio 20% (each 5% of yellow, magenta, cyan and black in full color mode) was continuously printed on 3,000 sheets of A4 sized paper under an ordinary temperature of 20° C. and a low humidity of 10% RH. An original picture having a fine line image, a portrait image, a solid white image and a black solid image each occupying quarter area of A4 size of the picture was printed at the initial time and after 3,000 prints as objects of the following evaluation.

(Fine Line Reproducibility)

The printed fine line image was magnified for 10 times by a loupe and number of fine lines in 1 mm width was counted for evaluating the resolving power.

(Density Unevenness)

Reflective density of the printed black solid image was measured at randomly selected ten points thereon by Macbeth Reflective Densitometer RD-918, and the unevenness of the image density was evaluated according to the difference between the highest and lowest densities among the above ten pints. Samples in which the difference between the highest density and the lowest density was less than 0.10 were judged as acceptable in either cases of the initial print and the after 3,000 prints.

Density of the white solid image was measured by the Macbeth Reflective Densitometer RD-918 and the relative density when the density of the transferring paper was set at 0 was evaluated. Samples in which the difference was less than 0.010 were judged as acceptable in either cases of the initial print and the after 3,000 prints.

Results of the evaluation are shown in Table 1.

TABLE 1

| | | | Evaluation of image | | | | | |
|---|---|---|---|---|---|---|---|---|
| | | | Resolving power (Lines) | | Fog | | Density unevenness | |
| | Developing roller No. | Peeling strength (N) | Initial | After 3,000 prints | Initial | After 3,000 prints | Initial | After 3,000 prints |
| Example 1 | 1 | 7.8 | 6 | 6 | 0.001 | 0.003 | 0.02 | 0.03 |
| Example 2 | 2 | 11.7 | 6 | 6 | 0.001 | 0.002 | 0.01 | 0.02 |
| Example 3 | 3 | 12.5 | 6 | 6 | 0.000 | 0.001 | 0.00 | 0.01 |
| Example 4 | 4 | 12.3 | 6 | 6 | 0.000 | 0.001 | 0.01 | 0.03 |
| Example 5 | 5 | 10.4 | 6 | 6 | 0.001 | 0.003 | 0.02 | 0.04 |
| Comparative example 1 | Comparative 1 | 3.3 | 6 | 4 | 0.001 | 0.018 | 0.02 | 0.19 |
| Comparative example 2 | Comparative 2 | 2.7 | 6 | 4 | 0.001 | 0.016 | 0.02 | 0.21 |

As is shown in Table 1, it was confirmed that sufficient adhering ability (peeling off strength) between the surface layer and the layer provided directly under the surface layer could be obtained in Examples 1 to 5 according to the invention. It was further confirmed that the fine line reproducibility was suitably maintained and occurrence of fogging was not observed even after 3,000 prints and any fault in the image caused by the influence of the remaining charge was not caused. No problem was not observed such as a fold, crack or peeling off. On the other hand, it was confirmed in Comparative Examples 1 and 2 that sufficient adhering could not obtained and fault in the fine line image by patchiness and fogging were caused before amounting 3,000 copies and stable image formation could not be performed.

As the above-described, printed matters having suitable image quality can be stably obtained even when the image formation is repeatedly performed by the use of the developing roller having the resin layer which has the area containing the silicone copolymer resin as the principal component and the area containing the resin-silica hybrid composite as the principal component provided around the electroconductive shaft.

The invention claimed is:

1. An image forming method comprising the steps of;

conveying a developer comprising a toner to a developing zone by a developing roller, and developing an electrostatic latent image formed on an electrostatic latent image carrying member by the developer, wherein the developing roller has an electroconductive shaft and resin layers provided around the shaft, and the resin layers comprises a surface layer containing silicone copolymer resin as the principal component and a layer containing resin-silica hybrid composite as a principal component provided directly under the surface layer, and directly on the electroconductive shaft.

2. The image forming method of claim 1 wherein a resin constituting the resin-silica hybrid composite contains a urethane-bond.

3. The image forming method of claim 2 wherein the resin constituting the resin-silica hybrid composite is a polyurethane resin.

4. The image forming method of claim 1 wherein a resin constituting the resin-silica hybrid composite comprises a vinyl polymer.

5. The image forming method of claim 4 wherein the vinyl polymer is composed of an acrylate or a methacrylate as a constituting monomer.

6. The image forming method of claim 1 wherein the shaft is a metallic material.

7. The image forming method of claim 1 wherein the resin layers consist of the surface layer and the layer containing resin-silica hybrid composite.

8. The image forming method of claim 1 wherein the developing roller consists of the shaft, the layer containing resin-silica hybrid composite provided adjacent to the electroconductive shaft and the surface layer adjacent to the layer containing resin-silica hybrid composite.

9. The image forming method of claim 1 wherein the developer is a single-component developer.

10. The image forming method of claim 9 wherein the developer is a non-magnetic single-component developer.

* * * * *